US011631294B2

(12) United States Patent
Parker et al.

(10) Patent No.: US 11,631,294 B2
(45) Date of Patent: Apr. 18, 2023

(54) ENHANCED VENDING MACHINE PRODUCT DELIVERY SYSTEM

(71) Applicant: Crane Payment Innovations, Inc., Malvern, PA (US)

(72) Inventors: Grey Parker, West Bloomfield, MI (US); William Koederitz, Royal Oak, MI (US); Curtis Bailey, Birmingham, MI (US); Brian McCormick, Aiken, SC (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 16/476,825

(22) PCT Filed: Jan. 12, 2018

(86) PCT No.: PCT/US2018/013657
§ 371 (c)(1),
(2) Date: Jul. 9, 2019

(87) PCT Pub. No.: WO2018/132763
PCT Pub. Date: Jul. 19, 2018

(65) Prior Publication Data

US 2019/0378367 A1 Dec. 12, 2019

Related U.S. Application Data

(60) Provisional application No. 62/445,694, filed on Jan. 12, 2017.

(51) Int. Cl.
*G07F 11/32* (2006.01)

(52) U.S. Cl.
CPC ..... *G07F 11/32* (2013.01)

(58) Field of Classification Search
CPC ..... G07F 11/32; G07F 11/165; G07F 11/1653
See application file for complete search history.

(56) References Cited

U.S. PATENT DOCUMENTS 5,472,113 A * 12/1995 Shaw ..... A61J 7/0084 221/15
6,199,720 B1 * 3/2001 Rudick ..... G07F 11/08 221/13

(Continued)

FOREIGN PATENT DOCUMENTS

CN 101308591 A 11/2008
CN 105453147 A 3/2016

(Continued)

OTHER PUBLICATIONS

International Search Report dated Apr. 5, 2018 in connection with International Patent Application No. PCT/US2018/013657, 1 page.

(Continued)

*Primary Examiner* — Gene O Crawford
*Assistant Examiner* — Kelvin L Randall, Jr.

(57) ABSTRACT

The present disclosure relates to a vending machine. The vending machine comprises an access port, a chassis including a plurality of trays and a plurality of columns, a movable stage, and a product catch coupled to the movable stage. The product catch is operable to move in a first direction to accept a product from one of the plurality of trays, and the product catch is operable to move in a second direction to deposit the product in the access port.

19 Claims, 32 Drawing Sheets

(56) References Cited

U.S. PATENT DOCUMENTS

| | | | | |
|---|---|---|---|---|
| 6,230,930 | B1 * | 5/2001 | Sorensen | G07F 11/16 221/131 |
| 6,415,950 | B1 * | 7/2002 | Robrechts | G07F 11/42 221/124 |
| 6,962,267 | B2 * | 11/2005 | Herzog | B65G 1/06 221/130 |
| 7,055,716 | B2 | 6/2006 | Holdway et al. | |
| 7,451,891 | B2 | 11/2008 | Carter et al. | |
| 8,096,444 | B2 | 1/2012 | Ardern et al. | |
| 8,820,574 | B2 * | 9/2014 | Howell | G07F 9/026 221/104 |
| 2001/0000610 | A1 * | 5/2001 | Johnson | G07F 11/42 221/13 |
| 2001/0048000 | A1 * | 12/2001 | Arai | G07F 11/62 221/119 |
| 2004/0056042 | A1 * | 3/2004 | Skavnak | G07F 11/30 221/289 |
| 2005/0067426 | A1 * | 3/2005 | Holdway | G07F 11/165 221/123 |
| 2007/0084876 | A1 * | 4/2007 | Ardern | G07F 11/163 221/258 |
| 2008/0093371 | A1 * | 4/2008 | Ubidia | B25J 9/041 901/14 |
| 2008/0179343 | A1 * | 7/2008 | Perkins | G07F 11/1653 221/208 |
| 2008/0283545 | A1 * | 11/2008 | Tsunoda | G07F 11/165 221/23 |
| 2008/0290108 | A1 * | 11/2008 | Tsunoda | G07F 11/30 221/133 |
| 2009/0084812 | A1 * | 4/2009 | Kirschner | G07F 11/42 221/186 |
| 2011/0068116 | A1 * | 3/2011 | Ardern | G07F 11/16 221/1 |
| 2015/0206373 | A1 * | 7/2015 | Kim | G07F 11/165 221/1 |
| 2015/0363993 | A1 * | 12/2015 | Stark | G06Q 10/087 221/6 |
| 2016/0196710 | A1 | 7/2016 | Nakajima et al. | |
| 2018/0108203 | A1 * | 4/2018 | Li | G07F 9/10 |

FOREIGN PATENT DOCUMENTS

| | | | |
|---|---|---|---|
| CN | 105518753 | A | 4/2016 |
| DE | 29817528 | U1 | 2/2000 |
| EP | 0991036 | A2 | 6/2006 |
| EP | 2012281 | A2 | 1/2009 |
| EP | 2568452 | A1 | 7/2012 |

OTHER PUBLICATIONS

Written Opinion of the International Searching Authority dated Apr. 5, 2018 in connection with International Patent Application No. PCT/US2018/013657, 9 pages.

Communication pursuant to Article 94(3) EPC in connection with European Application No. 18739242.8 dated Oct. 9, 2020, 6 pages.

Supplementary Partial European Search Report in connection with European Application No. 18739242.8 dated Sep. 28, 2020, 5 pages.

First Office Action dated Jan. 14, 2021 in connection with Chinese Application No. 201880013811.1, 24 pages.

Communication pursuant to Article 94(3) EPC dated Sep. 20, 2021, in connection with European Application No. 18739242.8, 6 pages.

The Second Office Action dated Oct. 14, 2021, in connection with Chinese Application No. 201880013811.1, 24 pages.

The Third Office Action dated May 6, 2022, in connection with Chinese Application No. 201880013811.1, 24 pages.

Notification to Grant Patent Right for Invention, Notice of Registration and Search Report dated Sep. 5, 2022, in connection with Chinese Application No. 201880013811.1, 6 pages.

Office Action dated Sep. 6, 2022, in connection with Mexican Application No. MX/a/2019/008336, 8 pages.

Office Action dated Jan. 9, 2023, in connection with Mexican Application No. MX/a/2019/008336, 12 pages.

* cited by examiner

ENHANCED VENDING MACHINE PRODUCT DELIVERY SYSTEM

CROSS-REFERENCE TO RELATED APPLICATIONS

This application is a 371 National Stage of International Application No. PCT/US2018/013657 filed on Jan. 12, 2018, which claims priority to U.S. Provisional Patent Application No. 62/445,694 filed on Jan. 12, 2017, the disclosures of which are incorporated herein by reference in their entirety.

TECHNICAL FIELD

The present disclosure is generally directed to vending machines. More specifically, the present disclosure is directed to a product delivery system in a vending machine.

BACKGROUND

Vending machines include many complex mechanisms. Today, many vending machines include electronic systems to select, pay, and dispense a product. Also, many vending machines include complex electro-mechanical systems for delivery of the product from a storage location to a customer accessible product retrieval location. These delivery systems in some of the vending machines may not provide a smooth transition of the product from a column to an access port. In particular, the transition of the product from a column to a cup may be rough.

SUMMARY

The present disclosure provides a product delivery system in a vending machine.

In one aspect thereof, a vending machine is provided. The vending machine includes an access port, a chassis including a plurality of trays and a plurality of columns, a movable stage, and a product catch coupled to the movable stage. The product catch is operable to move in a first direction to accept a product from one of the plurality of trays, and the product catch is operable to move in a second direction to deposit the product in the access port.

In another aspect thereof, a method of dispensing a product from a tray to a delivery port is provided. The method includes moving a product catch in a first direction, accepting a product from a plurality of trays, moving a stage to a discharge position, moving the product catch in a second direction, and depositing the product in an access port as a result of the movement of the product catch.

In another aspect thereof, a method of delivering a product in a vending machine from a column in a tray to a product catch is provided. The method includes providing a product catch coupled to a stage, initiating release of a product from the column, accepting by the product catch the product from the column, and pushing by a pusher assembly a next product in the column towards a release mechanism of the column, wherein the pusher assembly comprises a spring and a damper, and wherein the damper counteracts a force of the spring and decreases a velocity of the pusher assembly when the pusher assembly pushes the next product towards the release mechanism of the column.

Other technical features may be readily apparent to one skilled in the art from the following figures, descriptions, and claims.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of the present disclosure, reference is now made to the following description, taken in conjunction with the accompanying drawings, in which.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. The phrase "at least one of," when used with a list of items, means that different combinations of one or more of the listed items may be used, and only one item in the list may be needed. Definitions for certain words and phrases are provided throughout this patent document, those of ordinary skill in the art should understand that in many, if not most instances, such definitions apply to prior, as well as future uses of such defined words and phrases.

DETAILED DESCRIPTION

FIGS. 1 through 20, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device or system.

Figure 1:
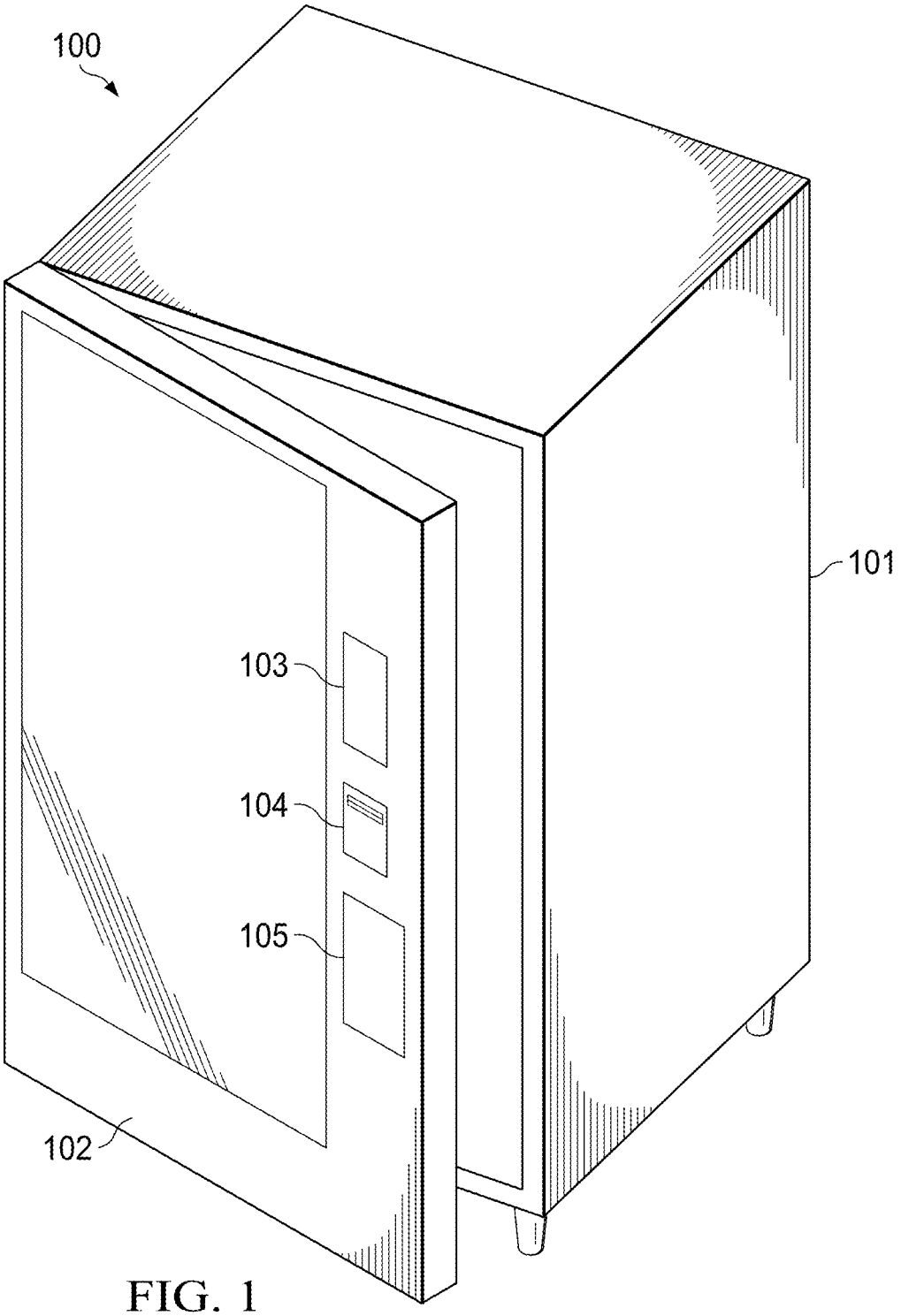
FIG. 1 illustrates a simplified perspective view of a vending machine according to embodiments of the present disclosure.

FIG. 1 illustrates a simplified perspective view of a vending machine 100 according to embodiments of the present disclosure. Vending machines come in a wide variety of configurations, and FIG. 1 does not limit the scope of the present disclosure to any particular implementation of a vending machine.

Vending machine 100 includes a cabinet 101 and a service door 102 that, together, define an enclosure. In the embodiment illustrated in FIG. 1, the service door 102 is pivotally mounted to the front of the cabinet 101 and extends all the way across the front face of the vending machine 100. In alternate embodiments, the service door may extend only part way across the front of the vending machine, or may be formed in two portions (of equal or unequal sizes) that swing open in opposite directions.

In the embodiment illustrated in FIG. 1, the service door 102 includes a customer user interface 103, illustrated as a touch screen liquid crystal display (LCD) display. A payment system 104 is mounted within the service door 102 and includes one or more of a bill validator, a coin acceptor and/or a credit or debit card reader. The payment system 104 receives currency, coins or other forms of payment from the customer and returns change as necessary. FIG. 1 also depicts an access port 105 to a delivery receptacle mounted within the service door 102 or in the cabinet 101. The access port 105 may have a delivery door or other mechanical system (e.g., rotatable delivery receptacle open on one side) for controlling or restricting access by the customer into the delivery receptacle, the interior of the vending machine, or both. Those skilled in the art will recognize that in some vending machines, particularly helical coil snack vending machines, the access port 105 may be located near the bottom of the vending machine and extend across most of the width of the machine, below a large glass window allowing the contents within the cabinet to be viewed or a large liquid crystal display selectively presenting images of products available for vending or advertisements. Other vending machines, in particular beverage vending machines, have X-Y product retrieval and delivery mechanisms and a glass front or large liquid crystal display, but may include an access port 105 to the side as shown in FIG. 1, at a height convenient to the customer for product retrieval.

Figure 2:
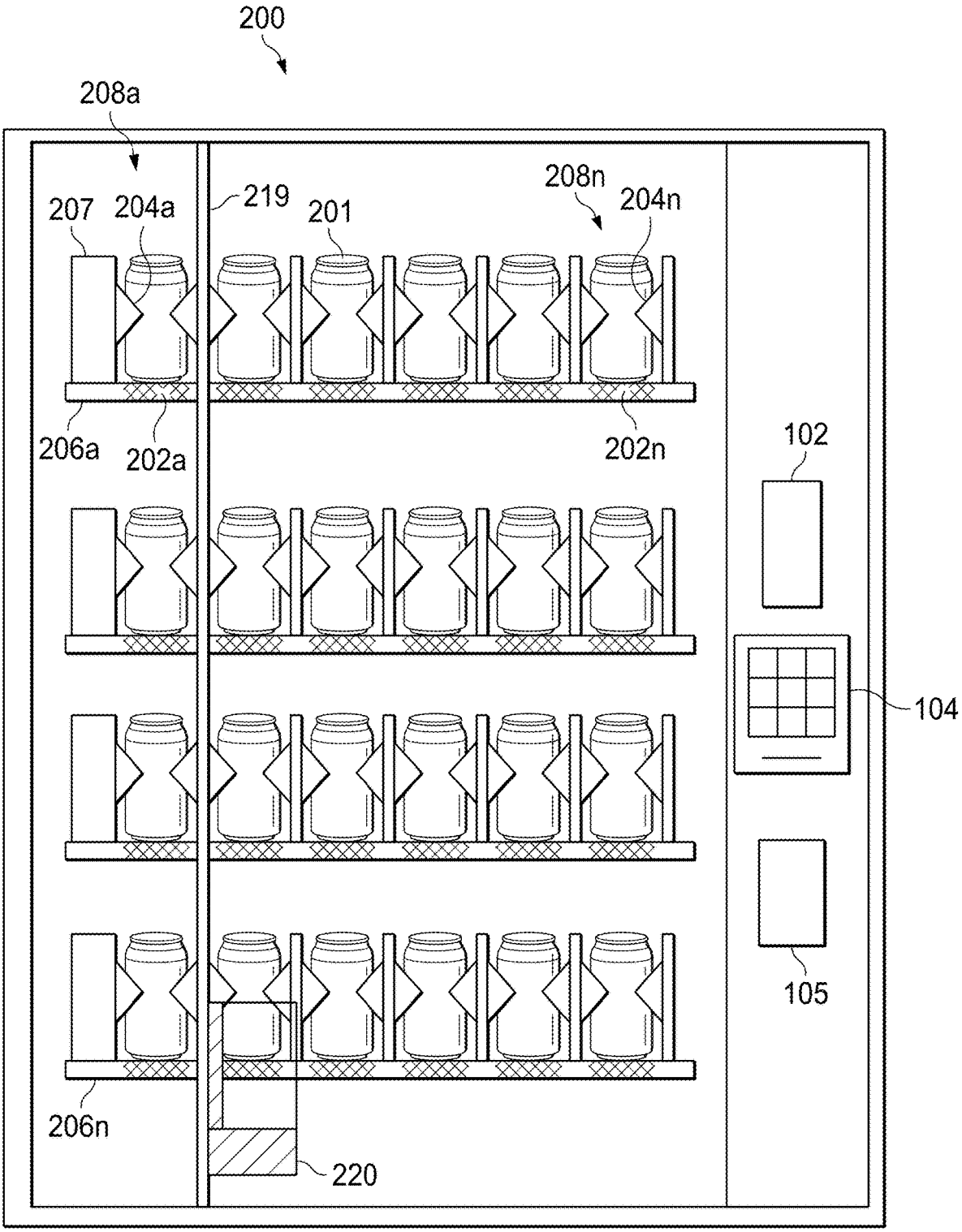
FIG. 2 illustrates a simplified perspective view illustrating a vending machine implementing a plurality of release mechanisms each for a plurality of gates according to embodiments of the present disclosure.

FIG. 2 illustrates a simplified perspective view illustrating a vending machine 200 implementing a plurality of release mechanisms 202*a* . . . 202*n* each for a plurality of gates 204*a* . . . 204*n* according to embodiments of the present disclosure. Vending machines come in a wide variety of configurations, and FIG. 2 does not limit the scope of the present disclosure to any particular implementation of a vending machine. The components of the vending machine 200 could be used with the vending machine 100 as shown in FIG. 1

The vending machine cabinet 101 houses a plurality of product trays 206*a* . . . 206*n*, each including a plurality of product columns 208*a*, 208*b* . . . 208*n*. For every product column 208*a*, there is at least one gate 204*a*. The plurality of gates 204*a* . . . 204*n* may be, but not limited to, double gates (as shown in FIG. 2 with one gate on each side of the product 201), cylindrical barriers, bars, rotational containers, and other types of barriers. The gates may be connected to a sidewall, such as sidewall 207.

In certain embodiments, for each gate 204*a*, there may be a release mechanism 202*a*. The release mechanism 202*a* can be manual or automatic. For example, release mechanism 202*a* can be motor with a gearbox, a knob, a lever, a solenoid, or some other suitable device. During a purchase of a product 201, the release mechanism 202*a* may interact with gate 204*a* that is restraining the product 201 located in column 208*a*. The release mechanism may interact with one or more gates that restrain products in a column. The interaction may allow the product 201 to move past gate 204*a*. The release mechanism 202*a* can be activated by a cup 220.

In certain embodiments, for each tray 206*a*, there is a release mechanism 202*a*. At each column, release mechanism 202*a* can release a product by interacting with a gate. As shown in this example embodiment, cup 220 is coupled to a movable stage 219 and is configured to move to a product via the movable stage 219 for vending of the product. In response to a user selection and a vend command, the movable stage 219 moves horizontally to align with a product column 208*a*, 208*b* . . . 208*n*, and cup 220 moves vertically along the movable stage 219 to a product to collect the product by activating the release mechanism 202*a* and capturing the product once released from the column. The cup 220 then moves to and dispenses the product into access port 105 for customer retrieval.

Figure 3A:
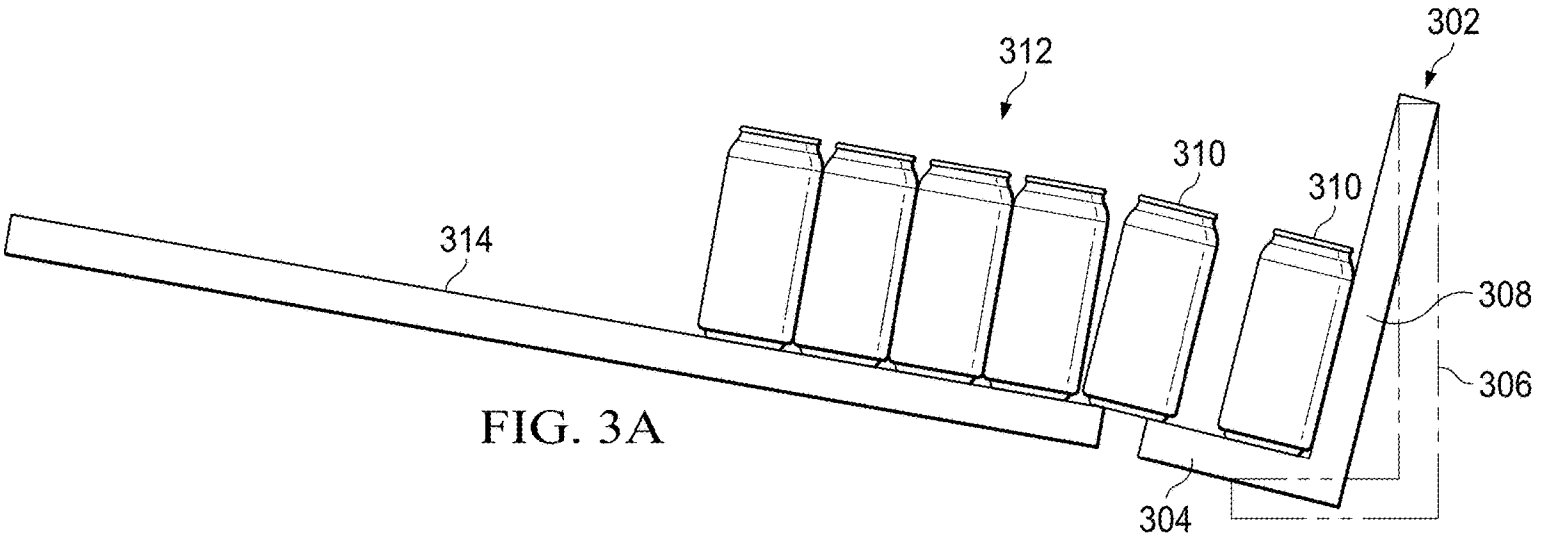
FIG. 3A illustrates a tilting cup in a product retrieval position according to embodiments of the present disclosure.
Figure 3B:
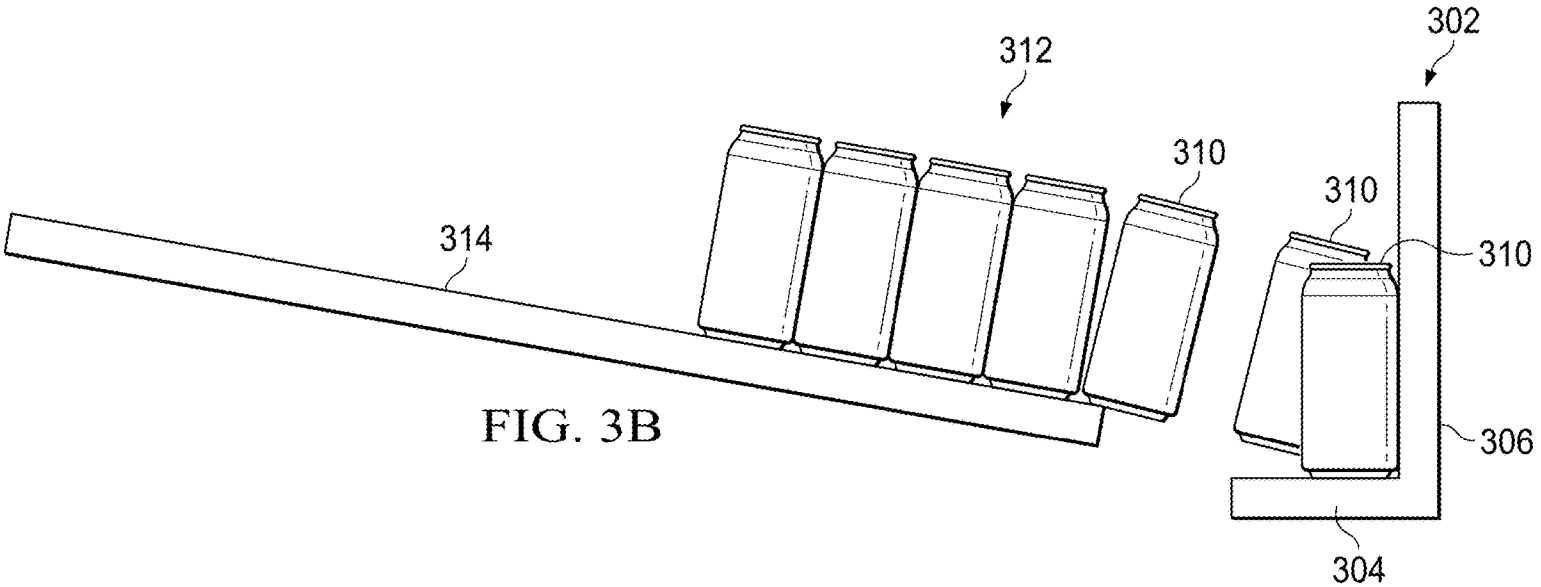
FIG. 3B illustrates a tilting cup in an initial position according to embodiments of the present disclosure.

FIGS. 3A and 3B illustrate a tilting cup 302 according to embodiments of the present disclosure. Tilting cups can come in a wide variety of configurations, and FIGS. 3A and 3B do not limit the scope of the present disclosure to any particular implementation of a tilting cup. The tilting cup 302 could be used with the vending machine 100 as shown in FIG. 1, or the vending machine 200 as shown in FIG. 2.

FIG. 3A illustrates a tilting cup 302 in a product retrieval position according to embodiments of the present disclosure. FIG. 3B illustrates the tilting cup 302 in an initial position according to embodiments of the present disclosure.

In some vending machine systems, when receiving a product, such as a canned drink, from a column or a product tray into a non-tilting cup or dispenser having a horizontal cup base, the product may tilt or bridge. Bridging occurs when the top of a product tilts during the vending process and is unable to move from the tray into the dispenser. The top of the product is in the dispenser and the bottom of the product remains in the tray, "bridging" the gap between the two. Tilting and bridging lead to failed product exchanges from the tray to the dispenser. Tilting and bridging in a non-tilted cup can happen due to the product transitioning from an angled product tray into a horizontal cup base. A tilted cup, such as tilting cup 302, allows the product to follow the path of motion of a falling product (e.g., can or bottle), eliminating the tilting and bridging.

As illustrated in FIGS. 3A and 3B, the tilting cup 302 has a shelf or "L" bracket that can be referred to as a base 304 of the tilting cup 302. The tilting cup 302 can tilt out from an initial position 306 to a tilted position 308 to accept a product 310 from a plurality of products 312 included on a product tray 314. The initial position 306 can be, for example, a vertical position (as shown in FIG. 2). The tilting cup 302 can be more stable and follow a path of motion of the falling product 310. To move the base 304 of the tilting cup 302 into the tilted position 308, the base 304 can move out towards the product tray 314 into the tilted position 308. The tilted position 308 can also be referred to as a receiving position.

The angle of the base 304 in the tilted position 308 can be similar to that of the angle of the column, or the portion of the column located nearest to the base. This angle of the tilting cup 302 when in the tilted position 308 can cause the base 304 of the tilting cup to be in line with the product tray 314 such that the product 310 can slide straight into the tilting cup 302 without any tilting or bridging of the product 310. The tilting cup 302 then returns to the initial position 306 for delivery. In some embodiments, the tilting cup 302 travels to near an access port, such as access port 105, to deposit the product 310 into the access port to allow a user to retrieve the product 310.

Figure 4A:
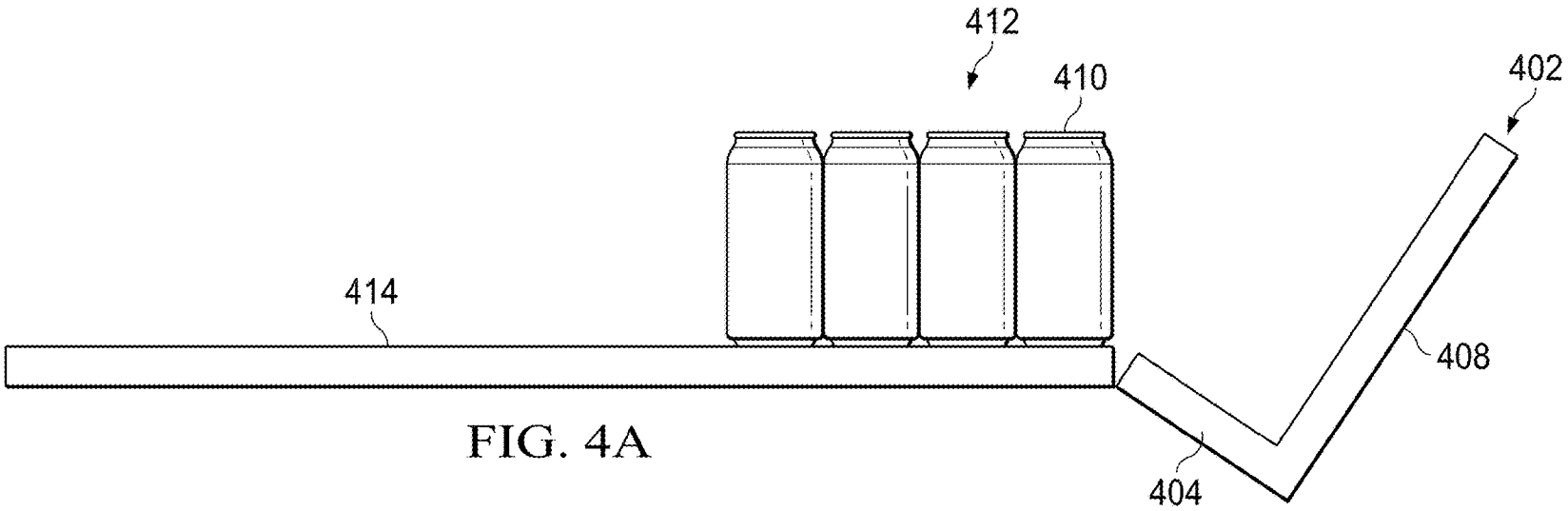
FIG. 4A illustrates a tilting cup in a position to receive a product from a product tray according to embodiments of the present disclosure.
Figure 4B:
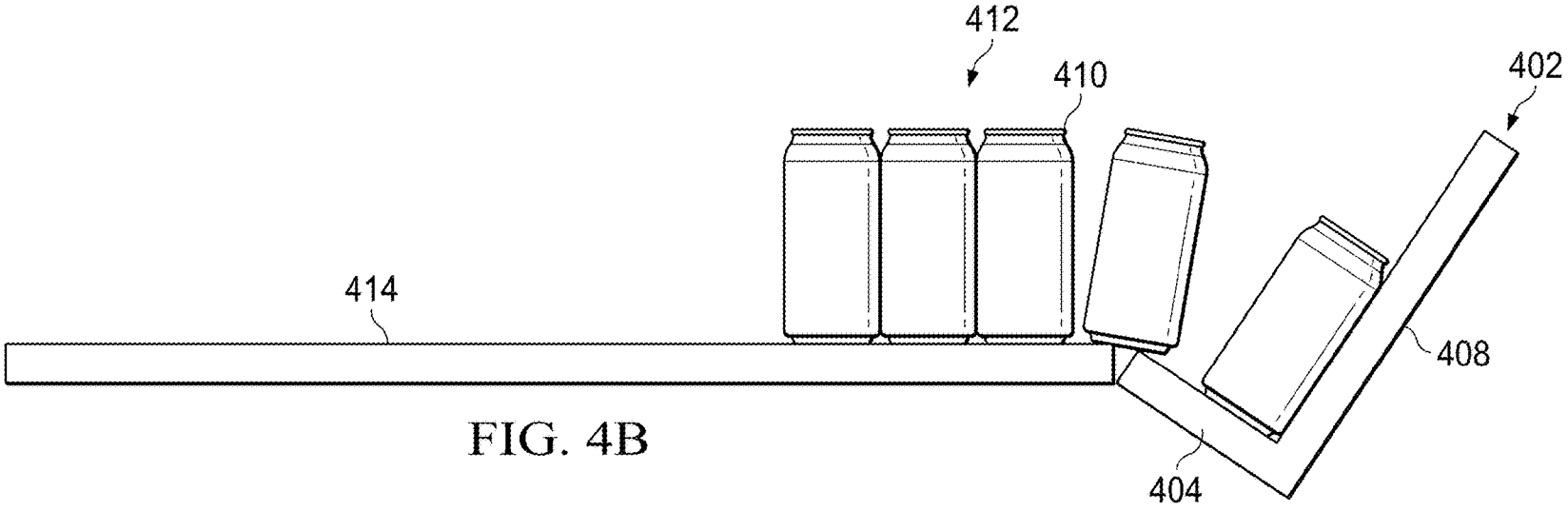
FIG. 4B illustrates a tilting cup in receipt of a product from a product tray according to embodiments of the present disclosure.

FIGS. 4A and 4B illustrate a tilting cup 402 according to embodiments of the present disclosure. Tilting cups can come in a wide variety of configurations, and FIGS. 4A and 4B do not limit the scope of the present disclosure to any particular implementation of a tilting cup. The tilting cup 402 could be used with the vending machine 100 as shown in FIG. 1, or the vending machine 200 as shown in FIG. 2.

FIG. 4A illustrates a tilting cup 402 in a position to receive a product from a product tray according to embodiments of the present disclosure. FIG. 4B illustrates a tilting cup 402 in receipt of a product from a product tray according to embodiments of the present disclosure.

The tilting cup 402 has a shelf or "L" bracket that can be referred to as a base 404 of the tilting cup 402. The tilting cup 402 can tilt out from an initial position (not shown) to a tilted position 408 to accept a product 410 from a plurality of products 412 included on a product tray 414. The initial position can be, for example, a vertical position (such as shown in FIGS. 2 and 3B). To move the base 404 of the tilting cup 402 into the tilted position 408, the base 404 can move out towards the product tray 414 into the tilted position 408. The tilted position 408 can also be referred to as a receiving position according to the present disclosure.

The angle of the base 404 in the tilted position 408 in some embodiments can be lower than that of the angle of the column and product tray 414, or the portion of the column located nearest to the base. For example, the angle of the base 404 can be near 45 degrees from the product tray 414, as shown in FIGS. 4A and 4B. This angle of the tilting cup 402 when in the tilted position 408 causes the product 410 to fall into the tilting cup without any tilting of the top of the product 410 against the tilting cup 402 or any bridging of the product 410. The tilting cup 402 then can return to the initial position for delivery of the product. In some embodiments, the tilting cup 402 travels to near an access port, such as access port 105, to deposit the product 410 into the access port to allow a user to retrieve the product 410.

FIGS. 5A-5J illustrate a tilting cup apparatus 500 according to embodiments of the present disclosure. Tilting cup apparatuses can come in a wide variety of configurations, and FIGS. 5A-5J do not limit the scope of the present disclosure to any particular implementation of a tilting cup apparatus. The tilting cup apparatus 500 could be used with the vending machine 100 as shown in FIG. 1, or the vending machine 200 as shown in FIG. 2.

Figure 5C:
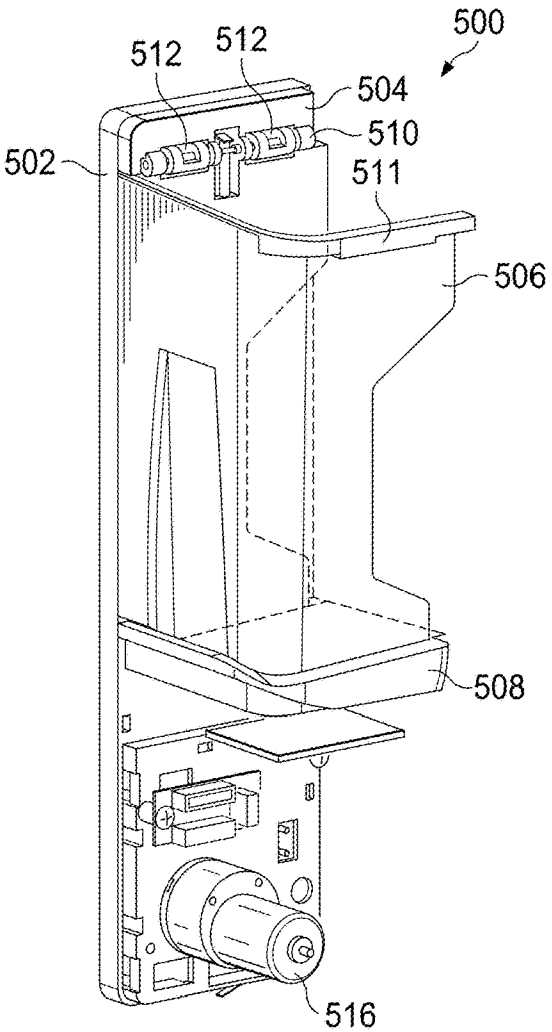
FIG. 5C illustrates a rear perspective view of a tilting cup apparatus in an initial position with a bottom cover removed exposing a motor according to embodiments of the present disclosure.
Figure 5B:
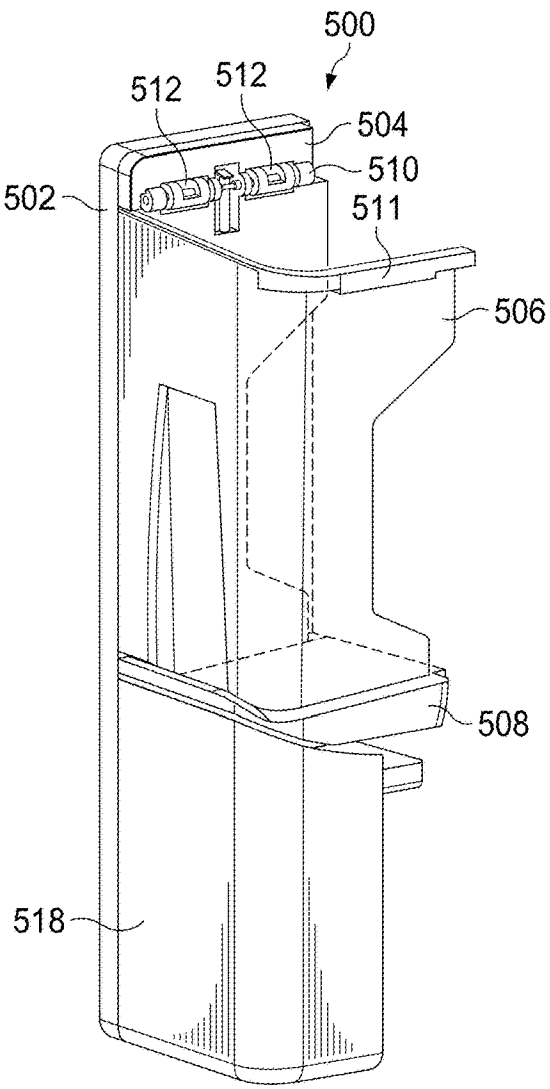
FIG. 5B illustrates a rear perspective view of a tilting cup apparatus in an initial position according to embodiments of the present disclosure.
Figure 5A:
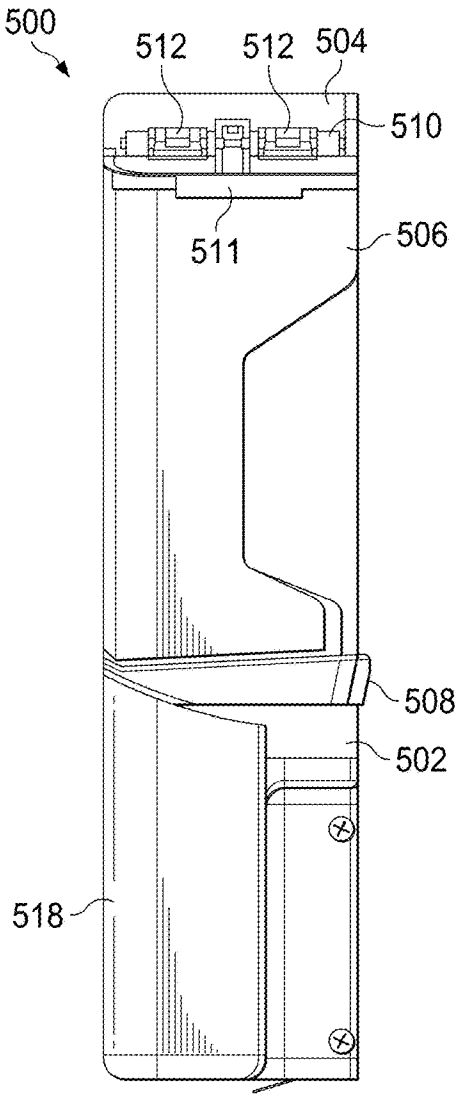
FIG. 5A illustrates a side view of a tilting cup apparatus in an initial position according to embodiments of the present disclosure.
Figure 5F:
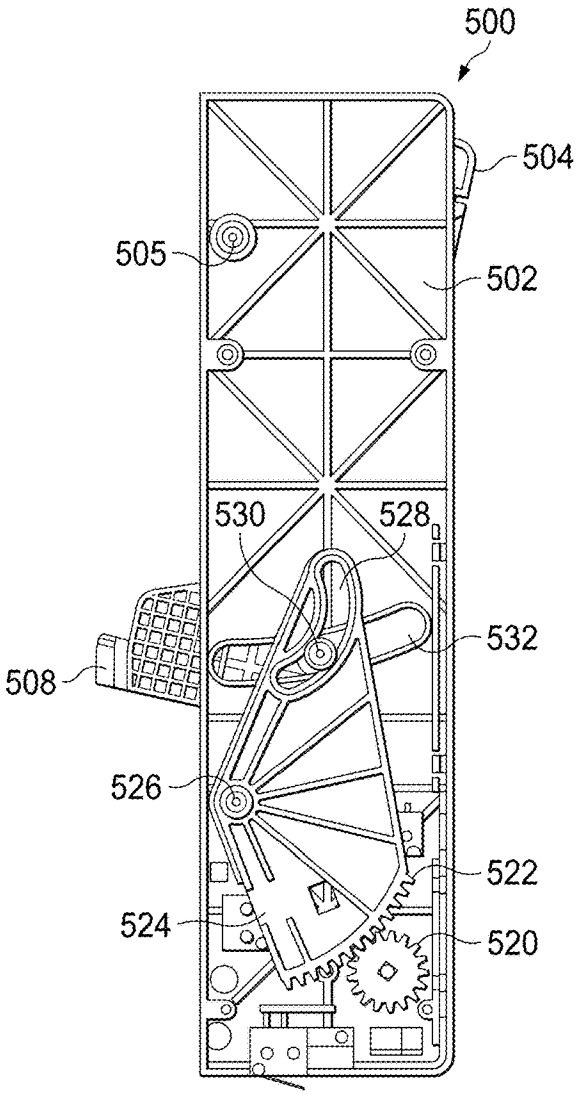
FIG. 5F illustrates a cross sectional view of a tilting cup apparatus in a mid-way position according to embodiments of the present disclosure.
Figure 5E:
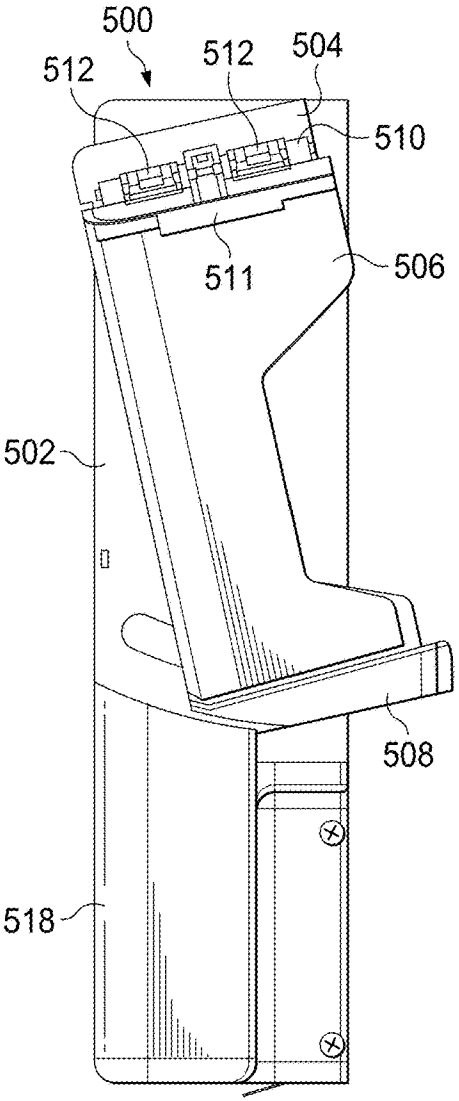
FIG. 5E illustrates a side view of a tilting cup apparatus in a mid-way position according to embodiments of the present disclosure.
Figure 5D:
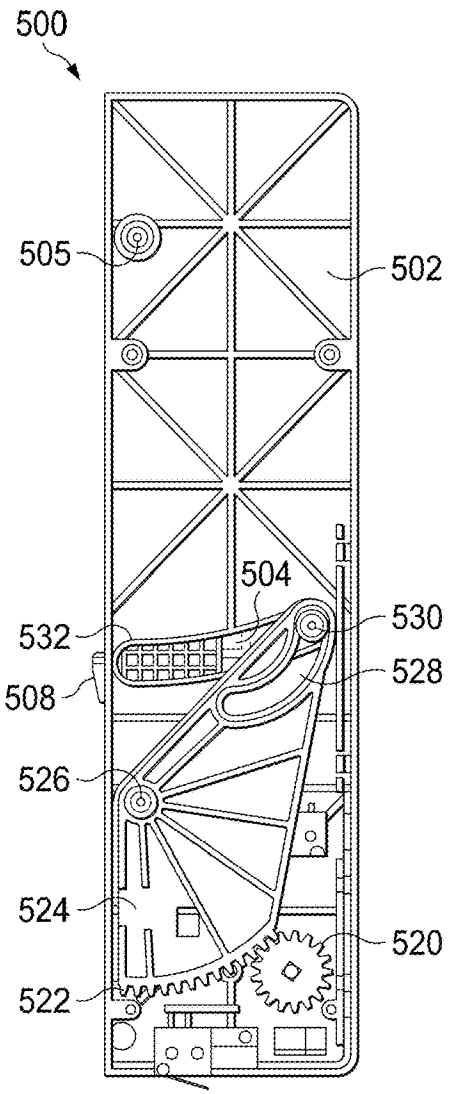
FIG. 5D illustrates a cross sectional view of a tilting cup apparatus in an initial position according to embodiments of the present disclosure.
Figure 5H:
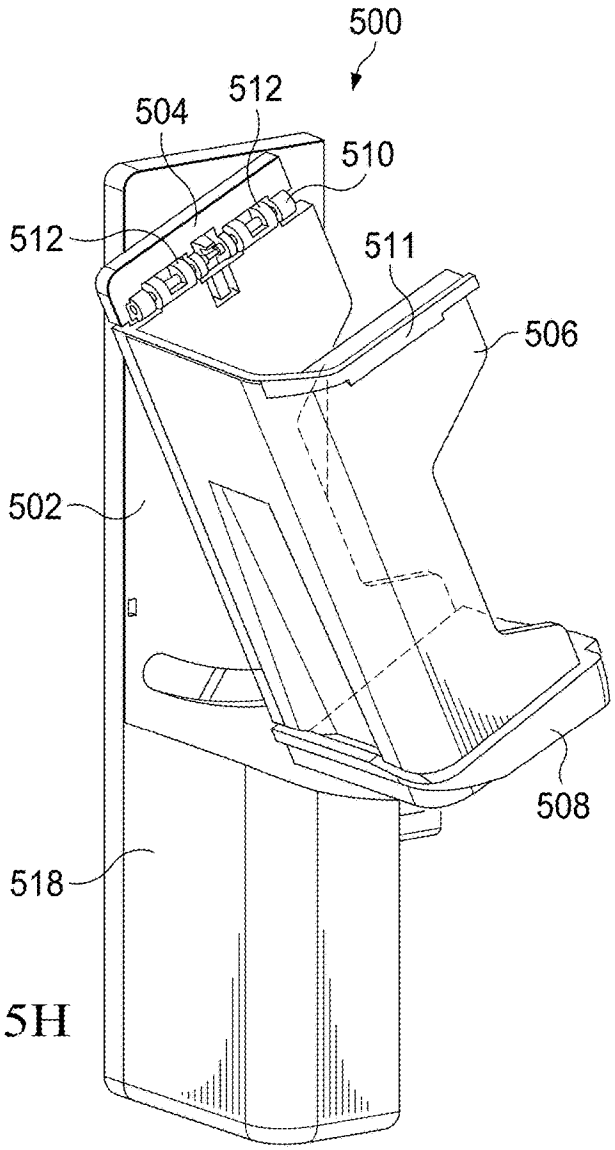
FIG. 5H illustrates a rear perspective view of a tilting cup apparatus in a retrieval position according to embodiments of the present disclosure.
Figure 5G:
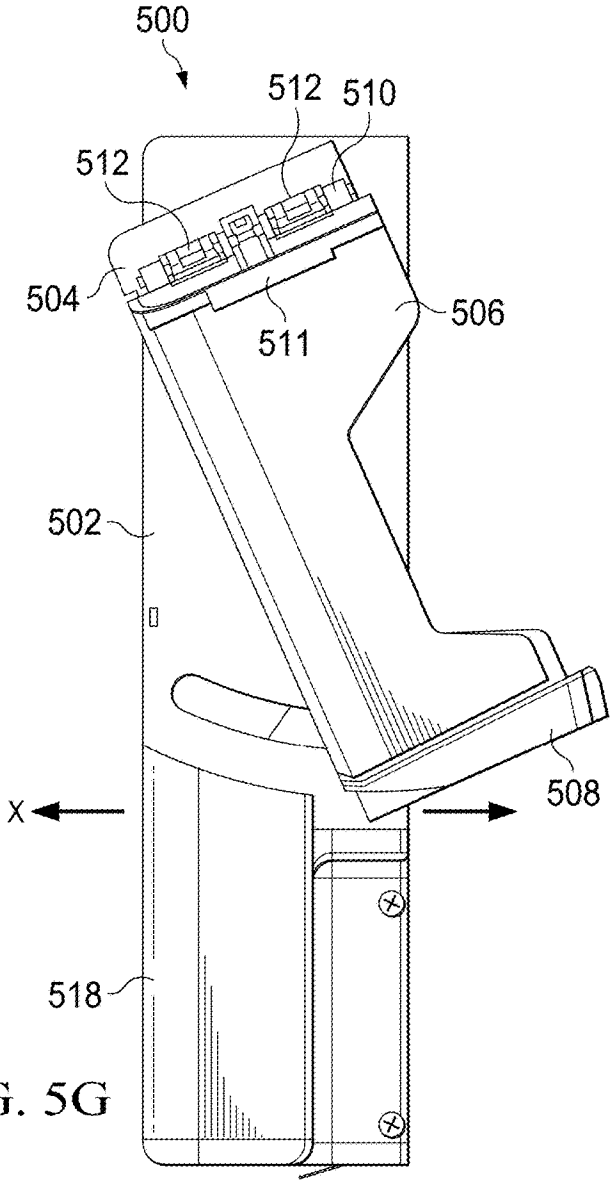
FIG. 5G illustrates a side view of a tilting cup apparatus in a retrieval position according to embodiments of the present disclosure.
Figure 5J:
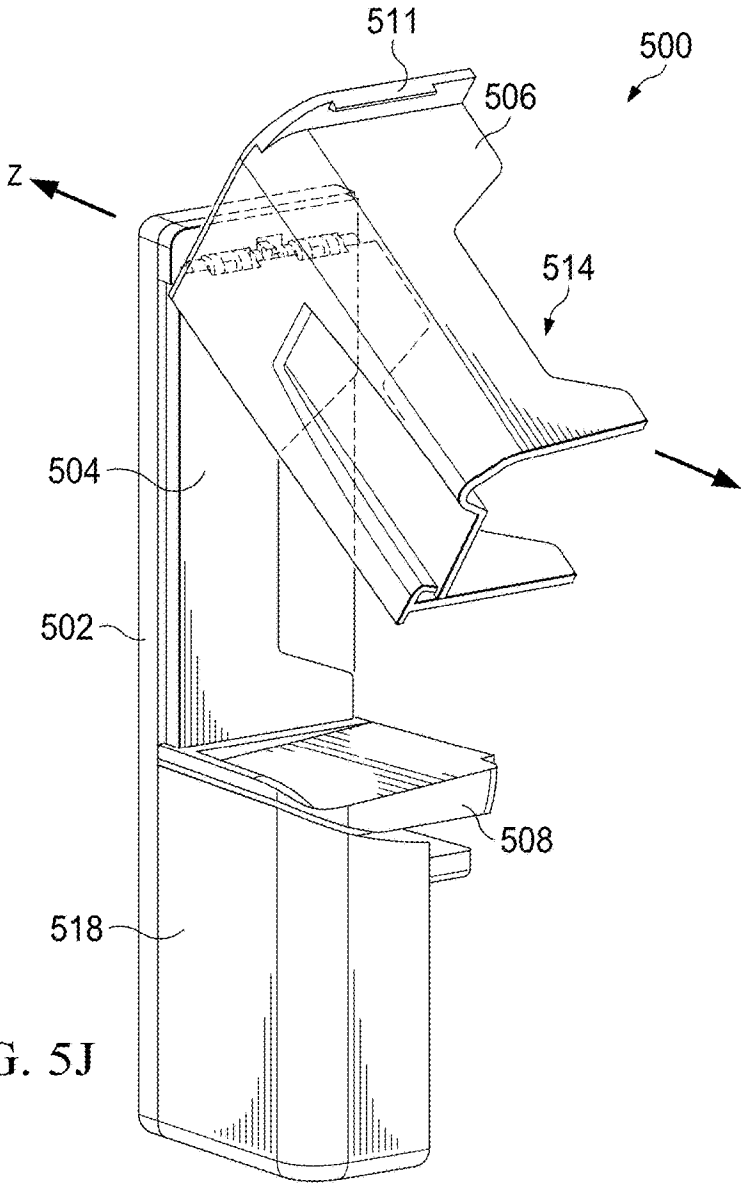
FIG. 5J illustrates a rear perspective view of a tilting cup apparatus in a product ejection position according to embodiments of the present disclosure.
Figure 5I:
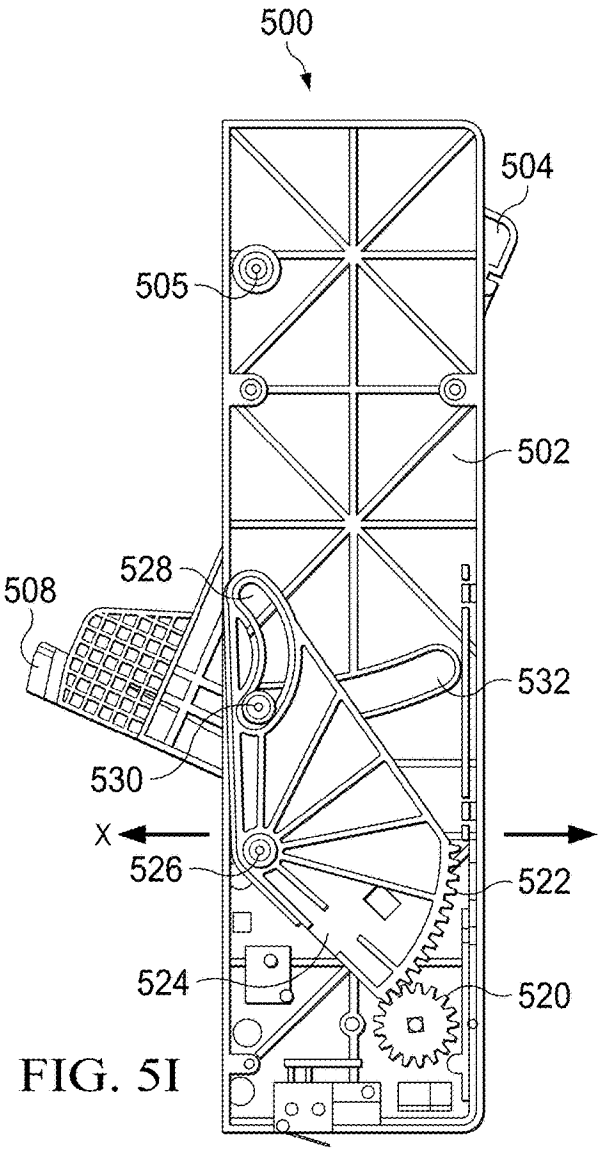
FIG. 5I illustrates a cross sectional view of a tilting cup apparatus in a retrieval position according to embodiments of the present disclosure.

FIG. 5A illustrates a side view of the tilting cup apparatus 500 in an initial position, FIG. 5B illustrates a rear perspective view of the tilting cup apparatus 500 in the initial position, FIG. 5C illustrates a rear perspective view of the tilting cup apparatus 500 in the initial position with a bottom cover removed exposing a motor; and FIG. 5D illustrates a cross sectional view of the tilting cup apparatus 500 in the initial position. FIG. 5E illustrates a side view of the tilting cup apparatus 500 in a mid-way position and FIG. 5F illustrates a cross sectional view of the tilting cup apparatus 500 in the mid-way position. FIG. 5G illustrates a side view of the tilting cup apparatus 500 in a retrieval position, FIG. 5H illustrates a rear perspective view of the tilting cup apparatus 500 in the retrieval position, and FIG. 5I illustrates a cross sectional view of the tilting cup apparatus 500 in the retrieval position. FIG. 5J illustrates a rear perspective view of the tilting cup apparatus 500 in a product ejection position.

The tilting cup apparatus 500 includes a frame 502 on which a plate 504 is rotatably coupled at a pivot point 505. A product catch 506 resides next to the plate 504 with a bottom of the product catch 506 disposed on top of a platform 508. In some embodiments, the frame 502 may be coupled to a movable stage, such as movable stage 219. In some embodiments, the product catch 506 may be directly or indirectly coupled to the movable stage. The connection to the plate 504 can constrain the motion of the platform 508. This allows the product catch 506 to travel with the plate 504 and the platform 508. The product catch 506 can be rectangular in shape with three sides closed and one open side for receiving a product from a tray in a vending machine. The product catch 506 can be transparent in some embodiments to allow a user of the vending machine to see the drink being delivered through the product catch 506. However, in other embodiments, the product catch 506 could be opaque.

The plate 504 includes a hinge 510 near a top of the plate 504. Tabs 512 of the product catch 506 are installed on the hinge 510. A ledge 511 at the top of the product catch 506 opposite the hinge 510 can come into contact with a wall or other component within the vending machine as the tilting cup apparatus travels down towards an access port, such as access port 105. When the ledge 511 comes into contact with a wall or other component in the vending machine the tabs 512 of the product catch 506 rotate around the hinge 510, rotating the product catch 506 out and away from the platform 508 to a product ejection position 514. The product ejection position 514 causes a product to be swept off the platform 508, where a bottom of the product is resting, by the product catch 506 and into an access port, such as access port 105, for retrieval by a user of the vending machine. In other embodiments, the product catch 506 extends out from the frame 504 without rotating, in order to deliver the product to the access port. For example, the product catch 506 can have an extendable arm coupled between the product catch 506 and the frame 504, or another component of the tilting cup apparatus 500. The extendable arm may, by operation of the motor or another mechanism, extend horizontally from the tilting cup apparatus 500 such that the product catch 506 slides sideways, without rotating, off the platform 508 and out over the access port, causing the product to be swept off the platform 508 and into the access port.

The tilting cup apparatus 500 further includes a rotation motor 516 that can be enclosed within a housing 518 in a bottom portion of the tilting cup apparatus 500 that is below the platform 508. The rotation motor 516 rotates a gear 520 that meshes with teeth 522 of a hinged plate 524, as illustrated in FIGS. 5D, 5F, and 5I. The hinged plate 524 includes a pivot point 526 near a front of the tilting cup apparatus 500. The pivot point 526 can be a hole in the hinged plate 524 through which a bolt or other fixation device can be installed. The hinged plate 524 also includes a curved slot 528 near a top of the hinged plate 524 through which another fixation device 530 is installed. The fixation device 530 is also installed through a frame slot 532 of the frame 502 of the tilting cup apparatus 500. The fixation device 530 is connected between the hinged plate 524 and the plate 504 on the other side of the frame 502, with the fixation device 530 traveling through the curved slot 528 of the hinged plate 524 and through the frame slot 532. In some embodiments, the fixation device 530 can be connected to the platform 508.

As the rotation motor 516 rotates the gear 520 meshed with the teeth 522, the hinged plate 524 rotates around the pivot point 526, while the fixation device 530 moves within both the curved slot 528 and the frame slot 532, pushing the plate 504 forward and causing the plate 504 to rotates around the pivot point 505. In other embodiments, the tilting cup apparatus 500 may slide forward instead of rotating. For example, the motor may instead push the platform 508 or the plate 504 forward at or near pivot point 505 or at or near the frame slot 532. For instance, the frame slot 532 may be a horizontal slot rather than a curved slot, with the fixation device 530 sliding forward through the horizontal slot such that the cup moves forward rather than rotating. FIGS. 5A-5D illustrates the plate 504 in an initial position 534. The initial position 534 allows for a product to rest on the platform 508 and travel with the tilting cup apparatus 500, and the initial position 534 also allows the tilting cup apparatus 500 to travel through a vending machine without coming into contact with other components in the vending machine. The plate 504 rotates from the initial position 534 to a retrieval position 536, as illustrated in FIGS. 5G-5I, passing a mid-way position 538 as illustrated in FIGS. 5E and 5F. As illustrated in FIG. 5I, to move to the retrieval position 536, the hinged plate 524 rotates forward, with the teeth 522 traveling across the gear 520 until reaching an end of the teeth 522. At the retrieval position 536, the platform 508 can contact a release mechanism such as release mechanisms 202*a* . . . 202*n* of FIG. 2. Depressing the release mechanism releases a product onto the platform 508. The plate 504 can then be rotated back to the initial position 534, now holding a product for delivery to a user of the vending machine. The hinged plate 524 provides for product retrieval that is configured to rotate about an X-axis while the hinge 510 rotates about a Z-axis.

FIGS. 6A-6D illustrate a product retrieval mechanism 600 according to embodiments of the present disclosure. Product retrieval mechanisms can come in a wide variety of configurations, and FIGS. 6A-6D do not limit the scope of the present disclosure to any particular implementation of a product retrieval mechanism. The product retrieval mechanism 600 could be used with the vending machine 100 as shown in FIG. 1, or the vending machine 200 as shown in FIG. 2.

Figure 6A:
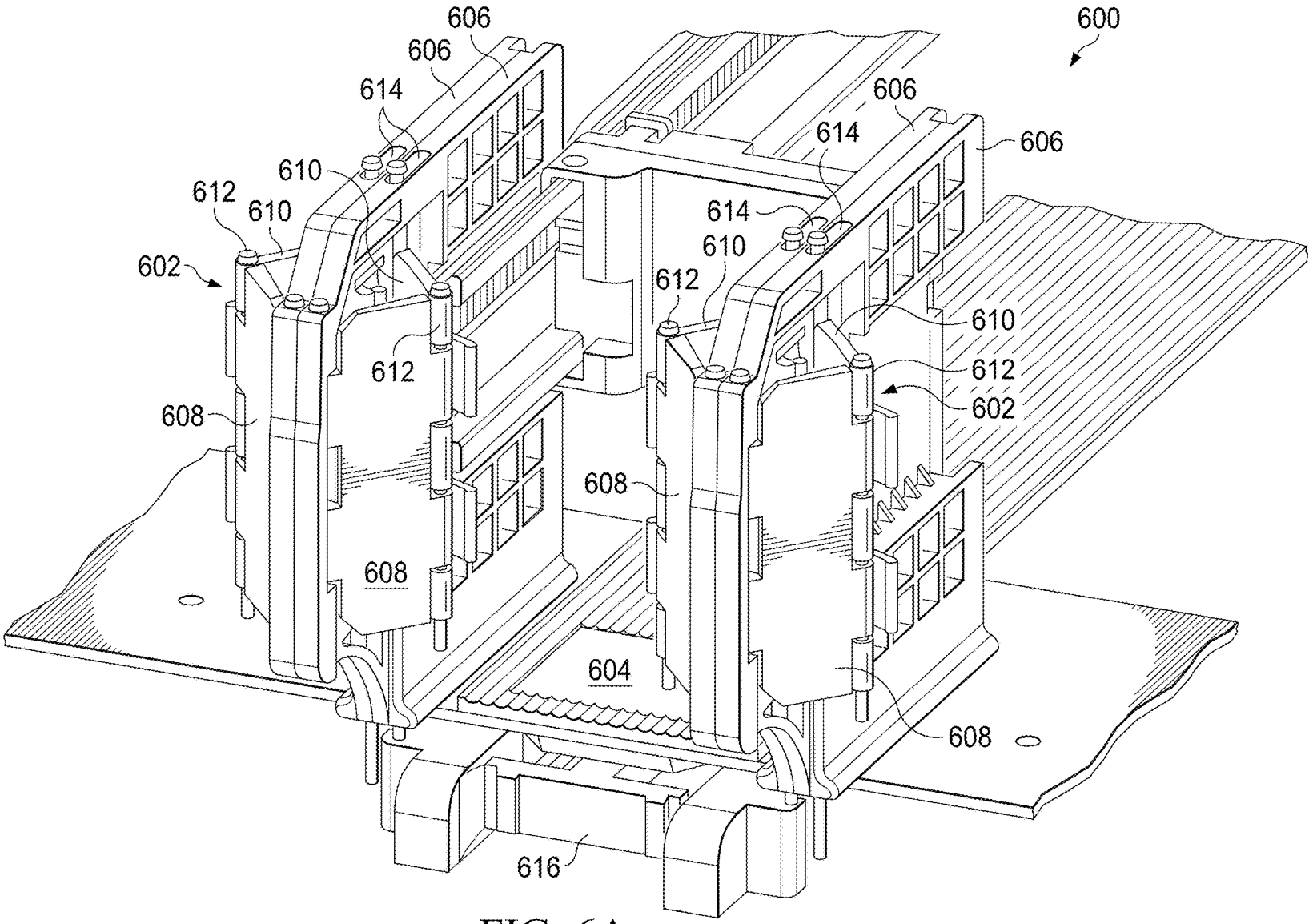
FIG. 6A illustrates a front perspective view of a product retrieval mechanism in a closed position according to embodiments of the present disclosure.
Figure 6B:
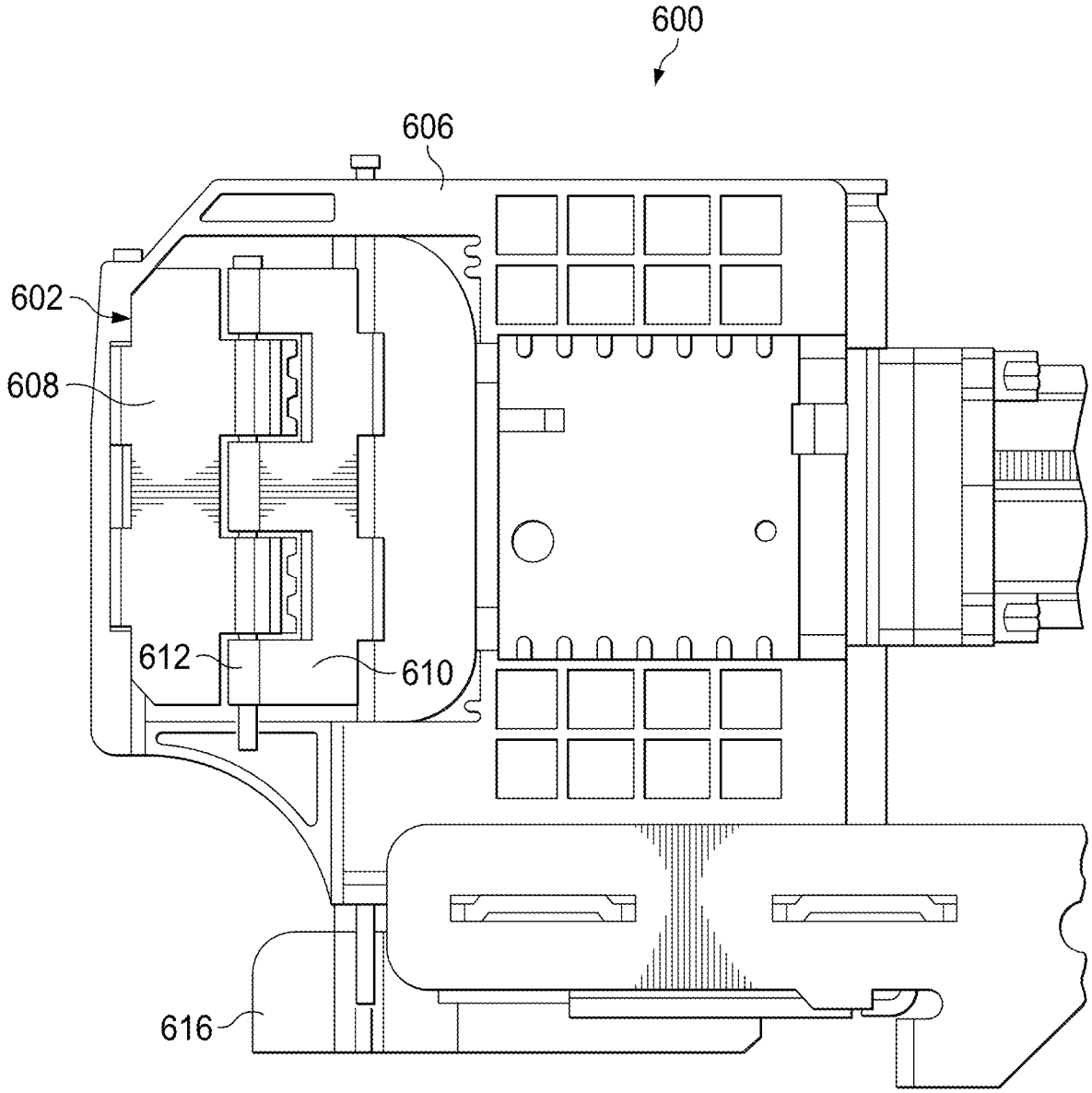
FIG. 6B illustrates a side view of a product retrieval mechanism in a closed position according to embodiments of the present disclosure.
Figure 6C:
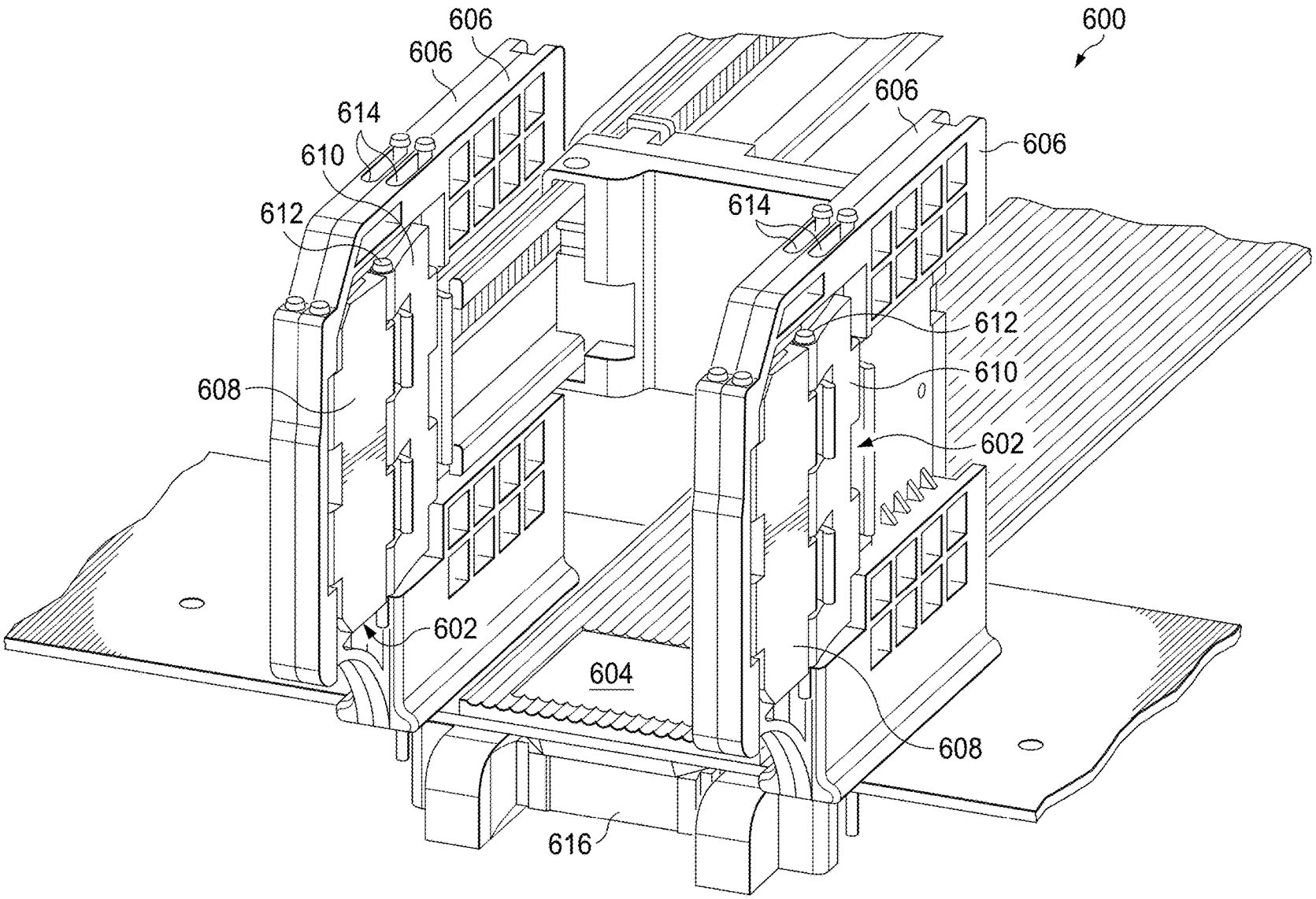
FIG. 6C illustrates a front perspective view of a product retrieval mechanism in an open position according to embodiments of the present disclosure.
Figure 6D:
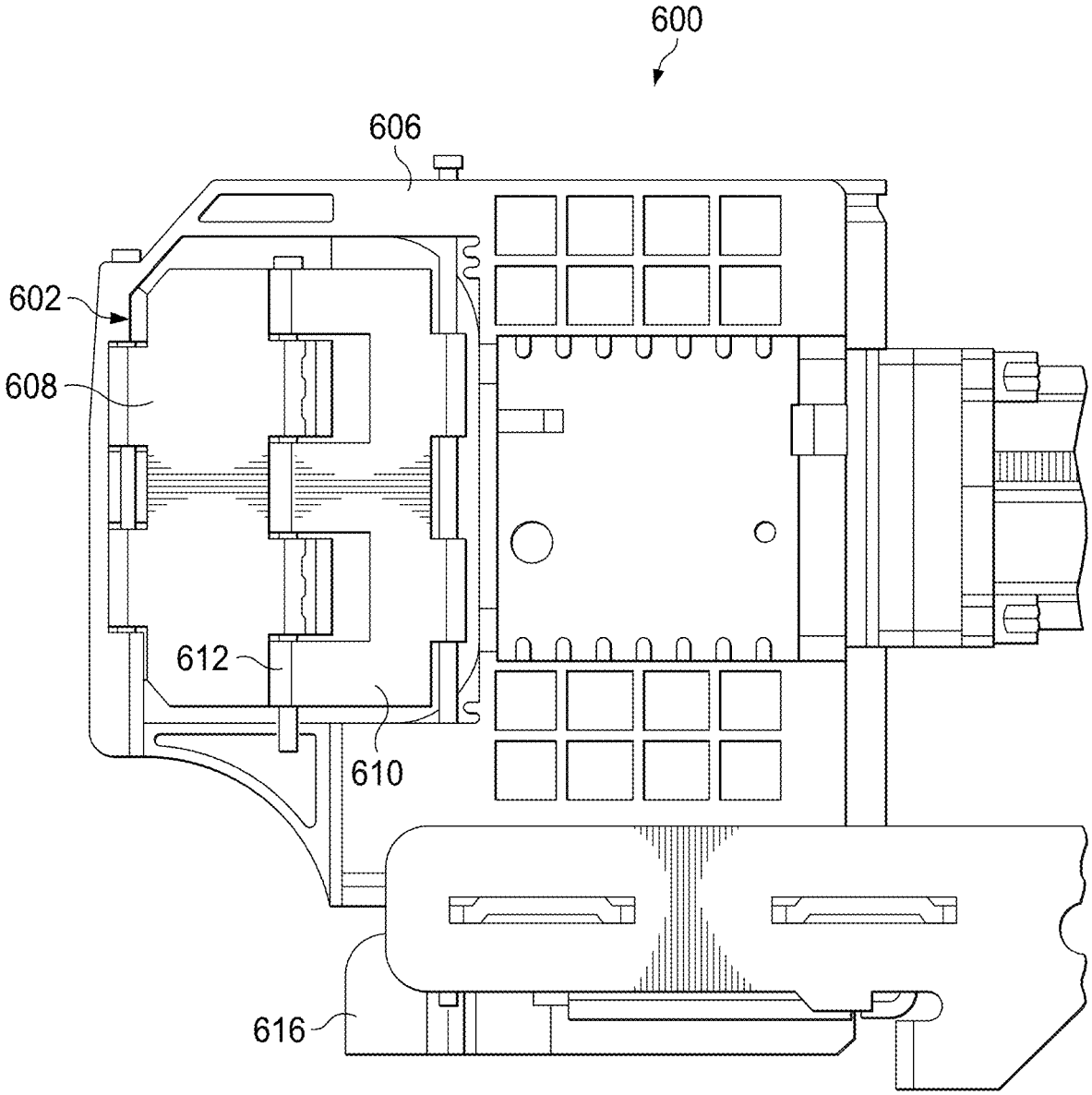
FIG. 6D illustrates a side view of a product retrieval mechanism in an open position according to embodiments of the present disclosure.

FIG. 6A illustrates a front perspective view of a product retrieval mechanism 600 in a closed position according to embodiments of the present disclosure. FIG. 6B illustrates a side view of the product retrieval mechanism 600 in the closed position according to embodiments of the present disclosure. FIG. 6C illustrates a front perspective view of the product retrieval mechanism 600 in the open position according to embodiments of the present disclosure. FIG. 6D illustrates a side view of the product retrieval mechanism 600 in the open position according to embodiments of the present disclosure.

The product retrieval mechanism 600 includes gates 602. The gates 602 serve to restrict products stored on a product column or a tray 604 from falling off the tray 604. The products can stand in a row between brackets 606, as the products move towards the end of the tray 604. Each of the gates 602 is installed on one of the brackets 606. Each of the gates 602 includes a first panel 608 and a second panel 610 connected by a hinge 612. The first panel 608 can be fixed to the front of one of the brackets 606 and the second panel can be slidably fixed to a top of the bracket through one or more slots 614. A release mechanism 616 (e.g., a button) is disposed in an open space in the tray 604 and below the gates 602 and the brackets 606.

A tilted cup base, such as platform 508 of FIGS. 5A-5J, can depress the release mechanism 616 to open the gates 602. When the release mechanism 616 is depressed (i.e., activated), the gates 602 can move from a closed position shown in FIGS. 6A and 6B to an open position shown in FIGS. 6C and 6D to allow product vending. The gates move between the closed position and the open position by extending down a length of the brackets 606, and through the slots 614, causing the panels 608 and 610 to press inward via the hinge 612 towards the brackets 606 and away from products on the tray 604. Thus, in the open position, the gates 602 flatten, allowing a product to escape and fall into a tilting cup. In various embodiments, the tilting cup can rotate forward to depress the release mechanism 616 and open the gates 602. In various embodiments, a shelf that is moved by a gear can extend outward to activate (i.e, depress) the release mechanism 616. In different embodiments, the mechanism restraining the product can be, in addition to a gate, cylindrical barriers, bars, rotational containers, and other types of barriers.

Figure 7A:
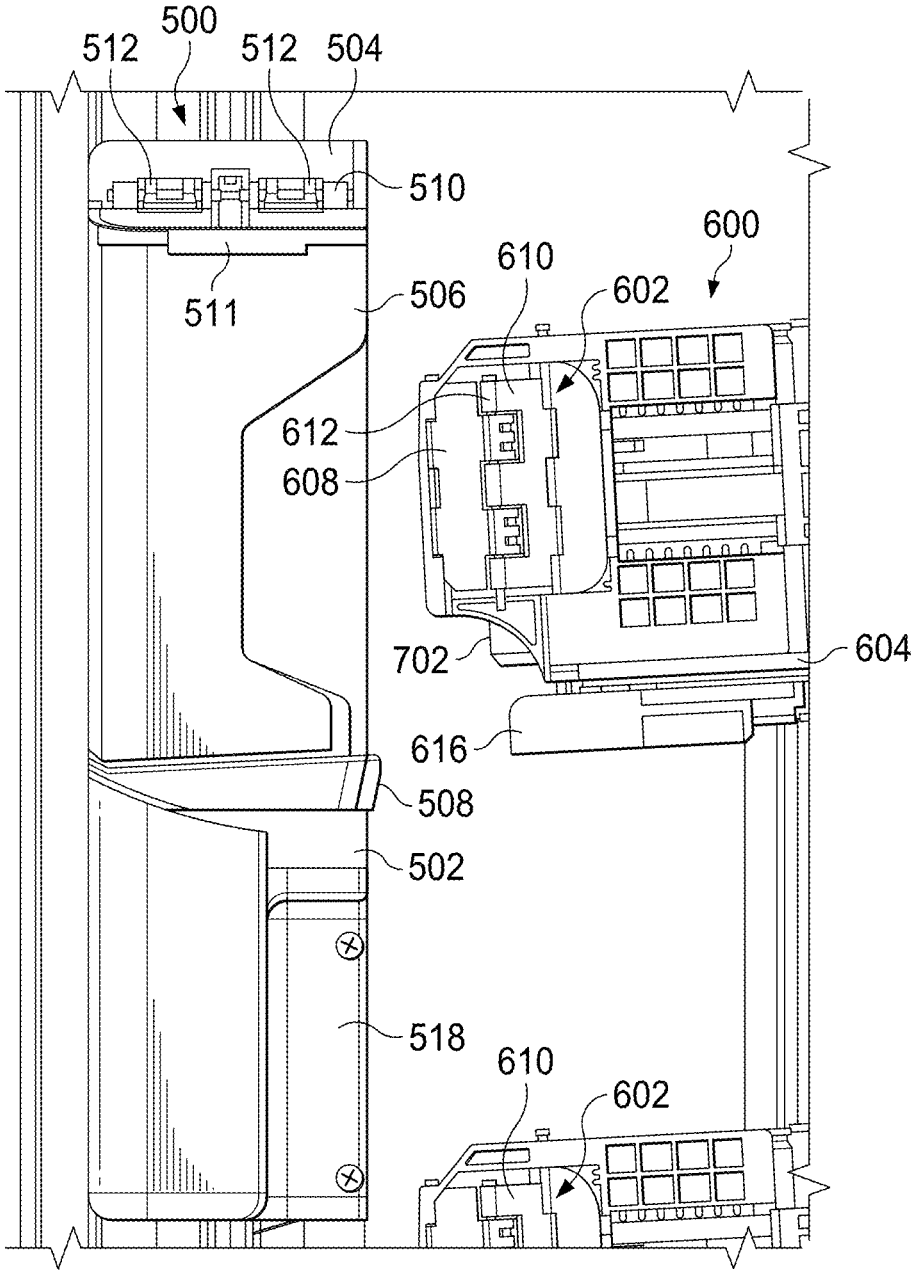
FIG. 7A illustrates a side view of a tilting cup apparatus in an initial position before interacting with a product retrieval mechanism according to embodiments of the present disclosure.
Figure 7B:
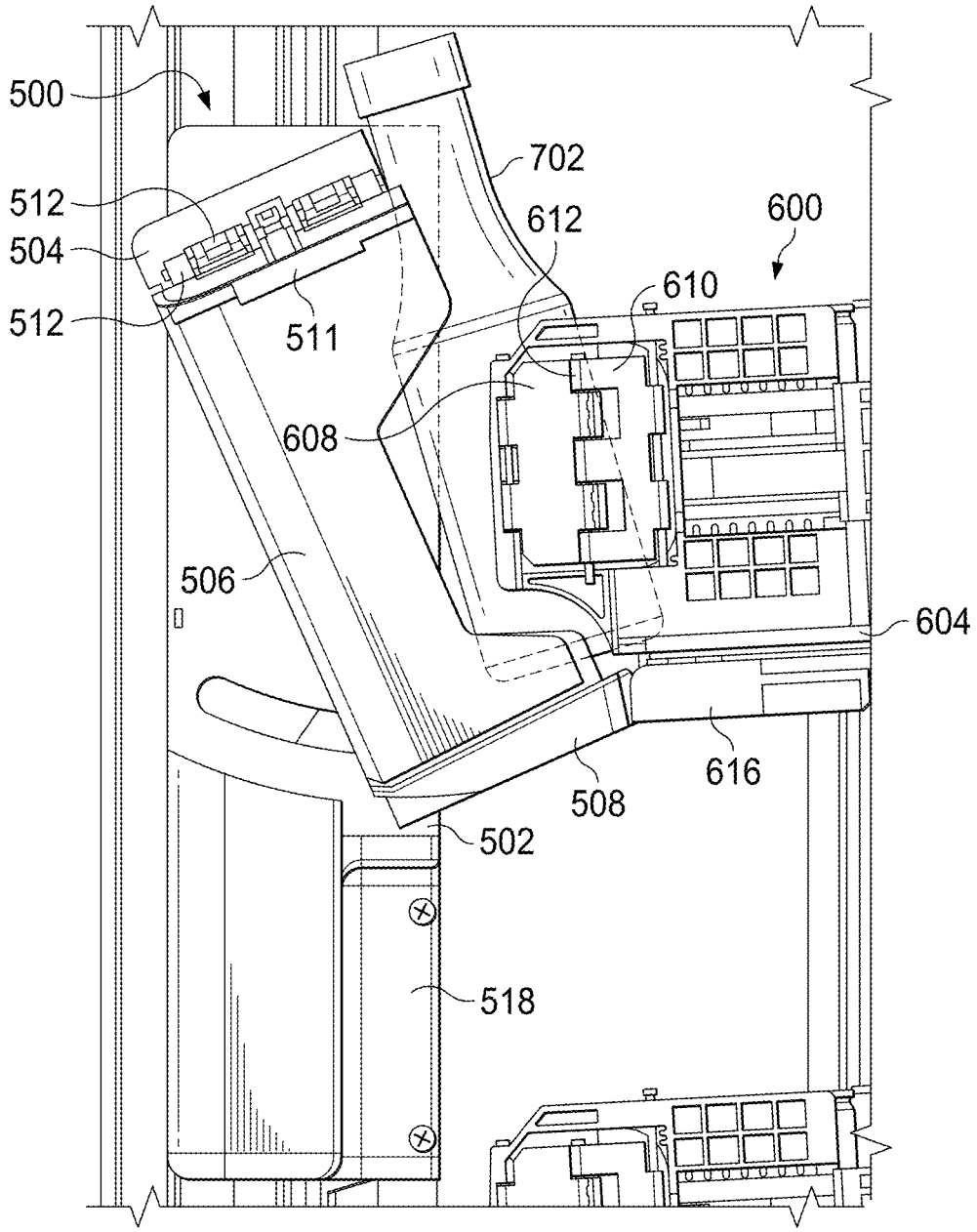
FIG. 7B illustrates a side view of a tilting cup apparatus in product retrieval position interacting with a product retrieval mechanism according to embodiments of the present disclosure.

FIGS. 7A and 7B illustrate the tilting cup apparatus 500 interacting with product retrieval mechanism 600 according to embodiments of the present disclosure. Tilting cup apparatuses and product retrieval mechanisms can come in a wide variety of configurations, and FIGS. 7A and 7B do not limit the scope of the present disclosure to any particular implementation of a tilting cup apparatus or product retrieval mechanism. The tilting cup apparatus 500 and the product retrieval mechanism 600 could be used with the vending machine 100 as shown in FIG. 1, or the vending machine 200 as shown in FIG. 2. It should be understood that other titling cups and product retrieval mechanisms provided by the present disclosure can be substituted into the vending machine illustrated in FIGS. 7A and 7B.

FIG. 7A illustrates a side view of the tilting cup apparatus 500 in an initial position before interacting with the product retrieval mechanism 600 according to embodiments of the present disclosure. FIG. 7B illustrates a side view of the tilting cup apparatus 500 in product retrieval position interacting with the product retrieval mechanism 600 according to embodiments of the present disclosure.

As illustrated in FIG. 7A, the tilting cup apparatus 500 in the initial position can move in front of a tray 604 containing one or more products 702. The one or more products 702 can be held on the tray 604 by the gates 602. As illustrated in FIG. 7B, when the plate 504 is rotated against the frame 502 as described in the present disclosure, the platform 508 comes into contact with and depresses the release mechanism 616, causing the gates 602 to open, releasing one of the one or more products 702. The one of the one or more products 702 falls onto the platform 508, and is surrounded by the product catch 506 on three sides, to keep the product securely on the platform 508 while the tilting cup apparatus travels through the vending machine to dispense the one of the one or more products 702 to a user of the vending machine. Dispensing the product 702 can be performed by the tilting cup apparatus 500 moving to the ejection position as shown in FIG. 5J to drop the product into an access port, such as access port 105.

Figure 8A:
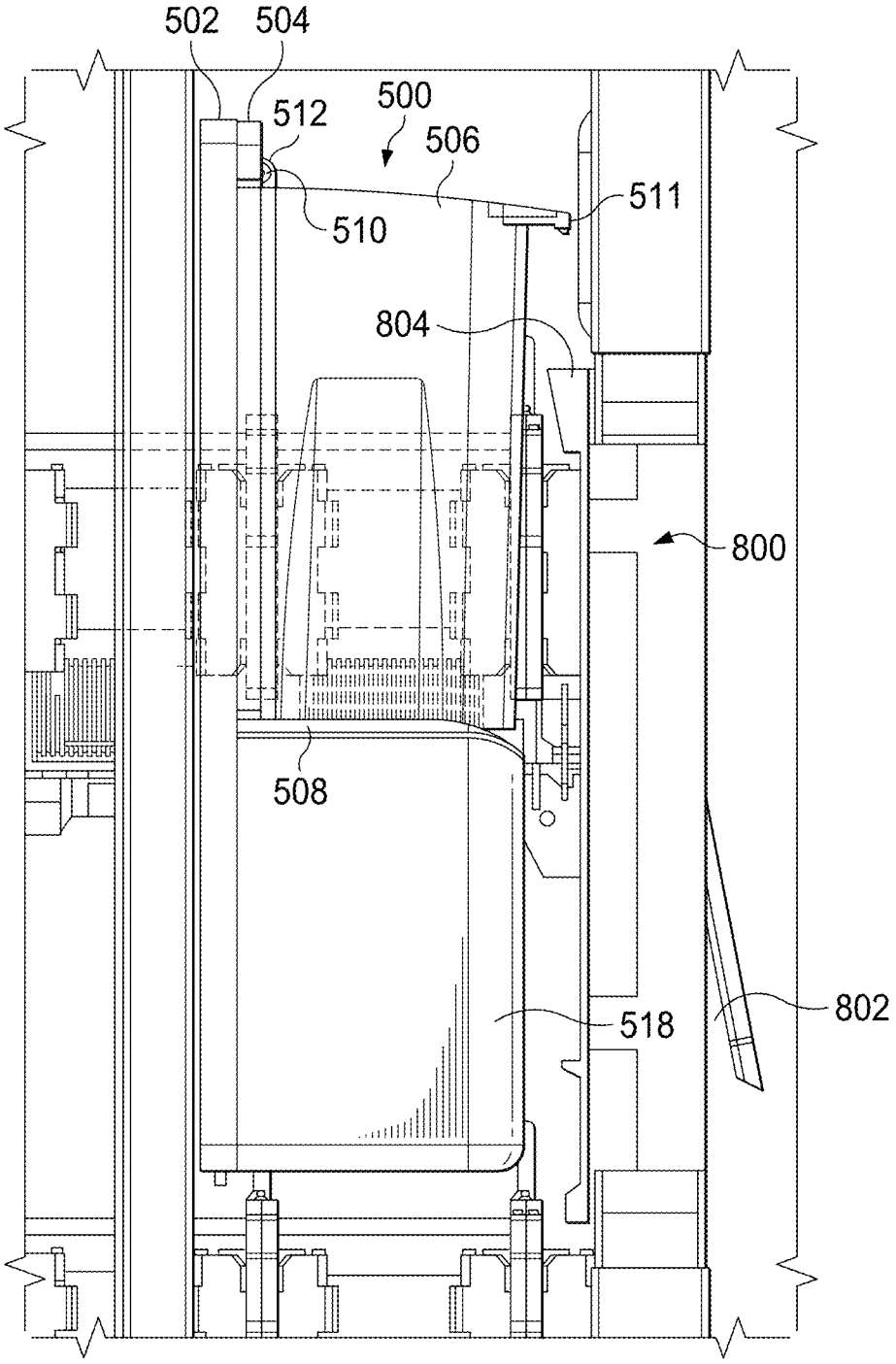
FIG. 8A illustrates a rear view of a tilting cup apparatus positioned above a discharge frame according to embodiments of the present disclosure.
Figure 8B:
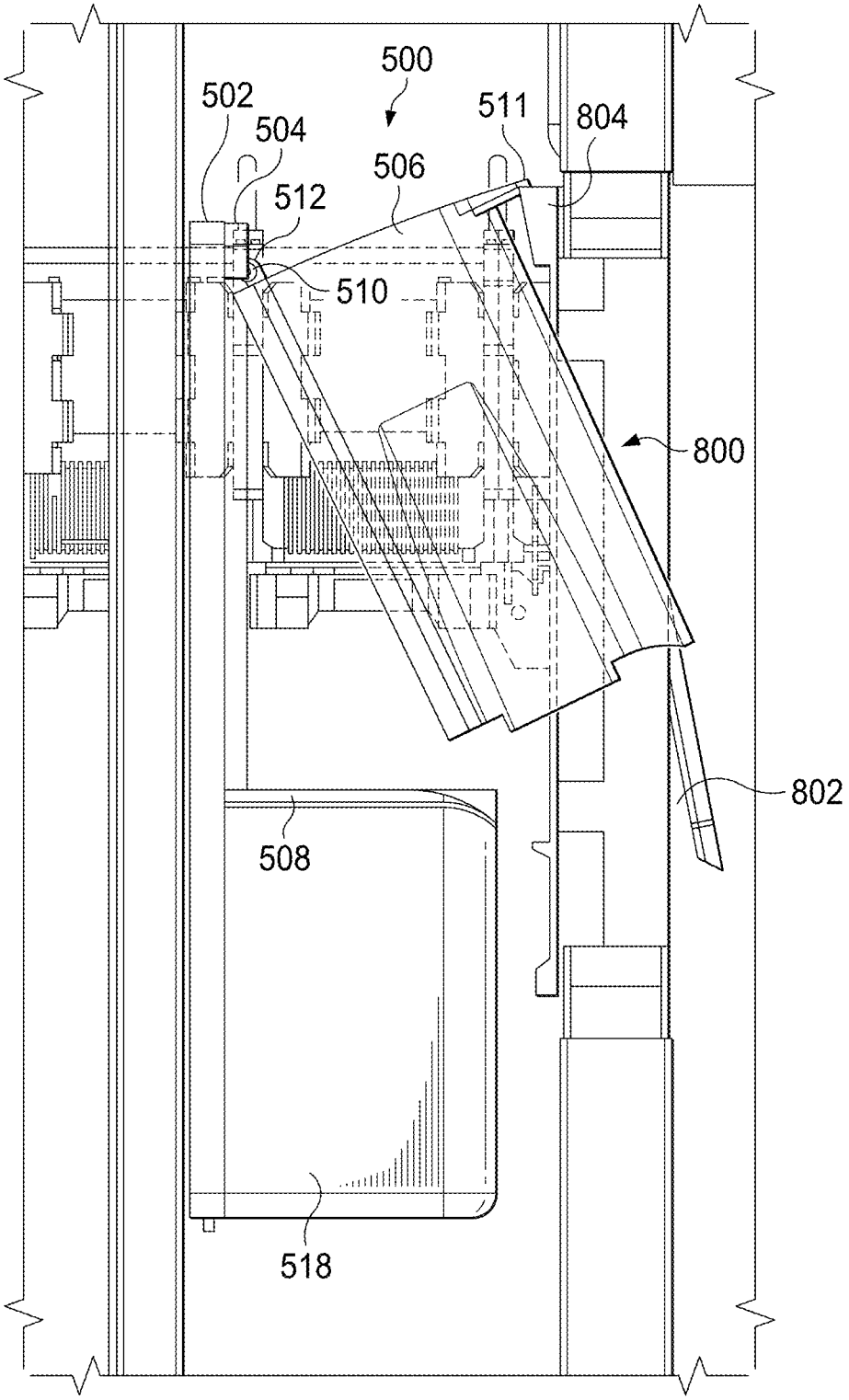
FIG. 8B illustrates a rear view of a tilting cup apparatus engaging a discharge frame according to embodiments of the present disclosure.

FIGS. 8A and 8B illustrate the tilting cup apparatus 500 engaging a discharge frame 800 according to embodiments of the present disclosure. Discharge frames can come in a wide variety of configurations, and FIGS. 8A and 8B do not limit the scope of the present disclosure to any particular implementation of a discharge frame. The discharge frame 800 could be used with the vending machine 100 as shown in FIG. 1, or the vending machine 200 as shown in FIG. 2.

FIG. 8A illustrates a rear view of the tilting cup apparatus 500 positioned above a discharge frame 800 according to embodiments of the present disclosure. FIG. 8B illustrates a rear view of the tilting cup apparatus 500 engaging the discharge frame 800 according to embodiments of the present disclosure.

The discharge frame 800 is disposed at a location in a vending machine near an access port 802. The discharge frame 800 includes a discharge ledge 804 secured to a wall of the vending machine. As the tilting cup apparatus 500 moves down towards the discharge frame 800, the ledge 511 of the product catch 506 comes into contact with the discharge ledge 804, causing the product catch 506 to rotate via the tabs 512 secured around the hinge 510. The rotation of the product catch 506 causes the product catch 506 to rotate up and away from the platform 508, where a product can be resting, into the product ejection position. The rotation thus causes the side of the product catch 506 that is near the plate 504 to come into contact with a product and push the product off the platform 508 and into the access port 802. The tilting cup apparatus 500 can then move back up, causing the ledge 511 to cease contacting the discharge ledge 804. Once the ledge 511 ceases contact with the discharge ledge 804, the product catch 506 can then rotate back to the initial position.

FIGS. 9A-9D illustrate a tilting cup apparatus 900 according to various embodiments of the present disclosure. Tilting cup apparatuses can come in a wide variety of configurations, and FIGS. 9A-9D do not limit the scope of the present disclosure to any particular implementation of a tilting cup apparatus. The tilting cup apparatus 900 could be used with the vending machine 100 as shown in FIG. 1, or the vending machine 200 as shown in FIG. 2.

Figure 9A:
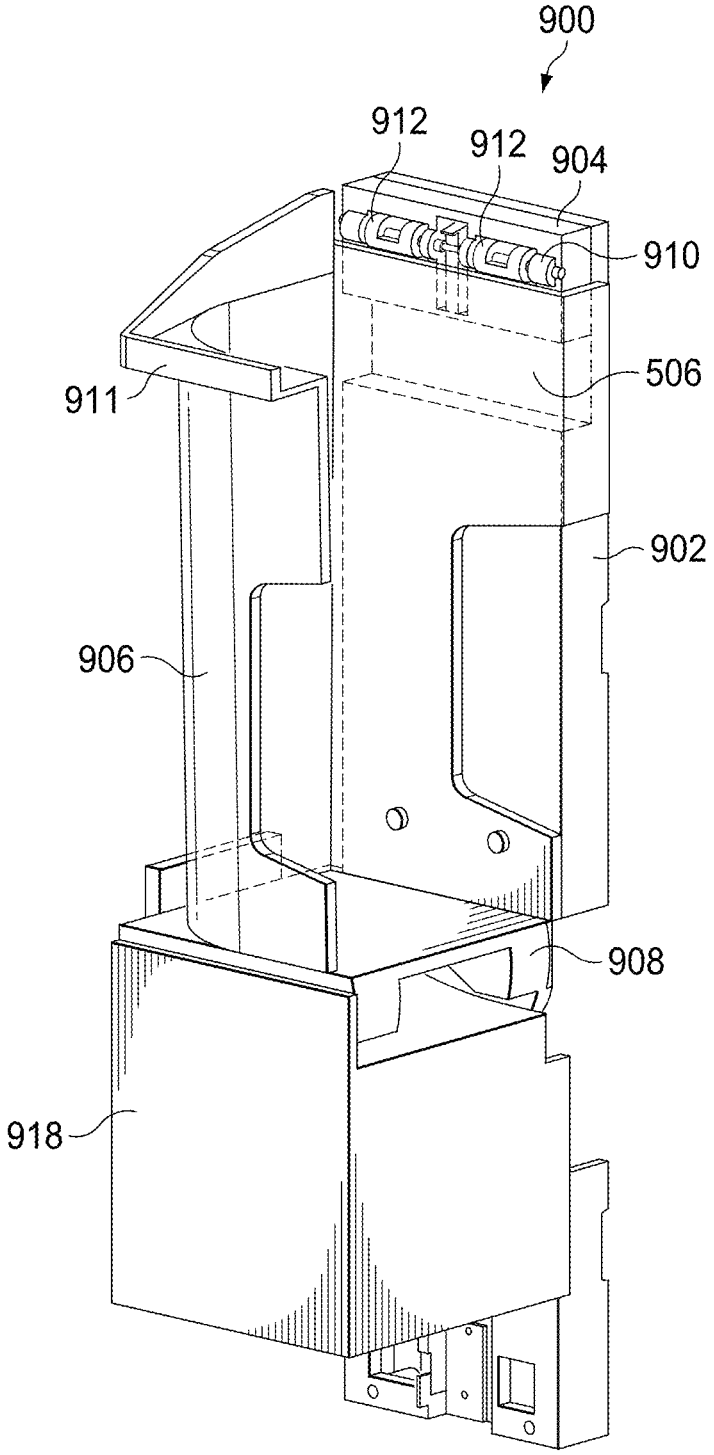
FIG. 9A illustrates a front perspective view of a tilting cup apparatus according to various embodiments of the present disclosure.
Figure 9B:
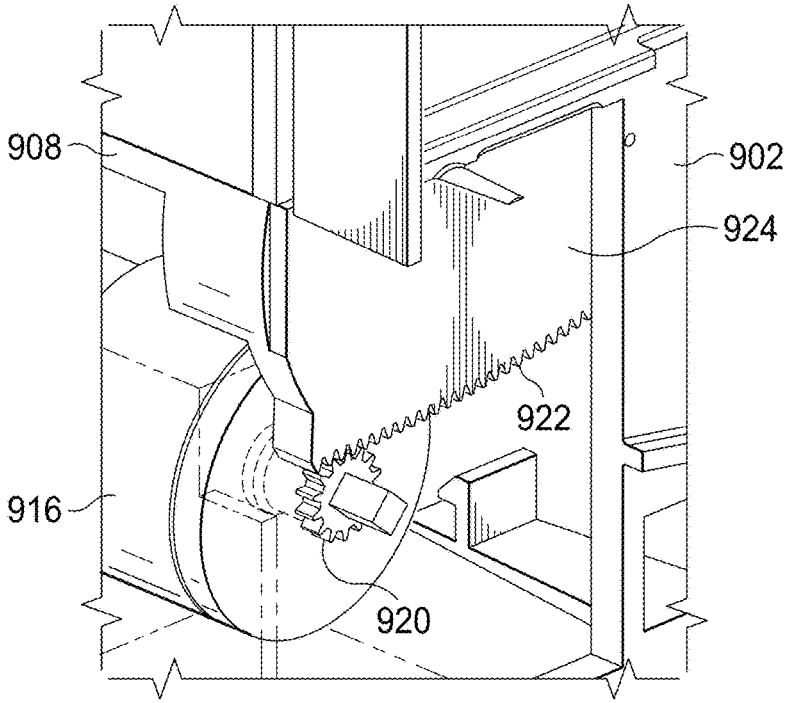
FIG. 9B illustrates a side perspective view of a motor of a tilting cup apparatus according to various embodiments of the present disclosure.
Figure 9C:
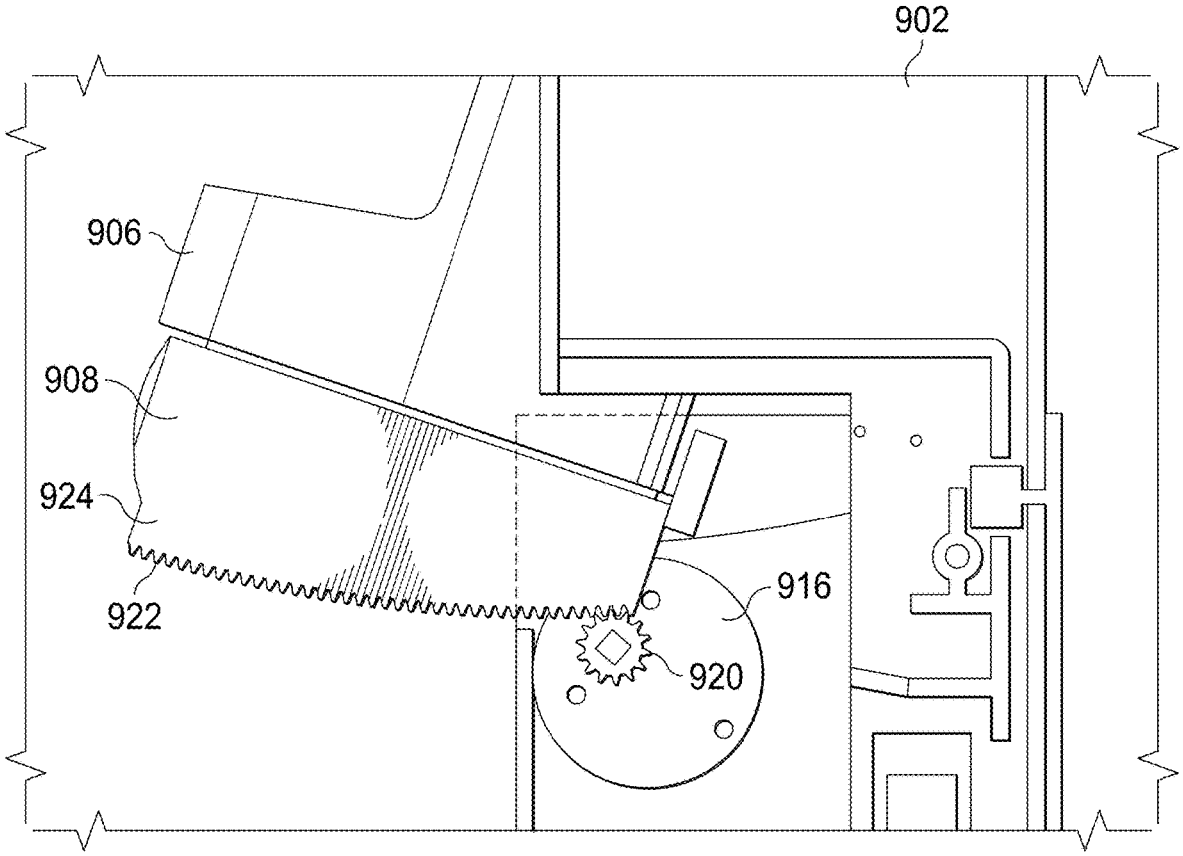
FIG. 9C illustrates a side cross sectional view of a bottom portion of a tilting cup apparatus according to various embodiments of the present disclosure.
Figure 9D:
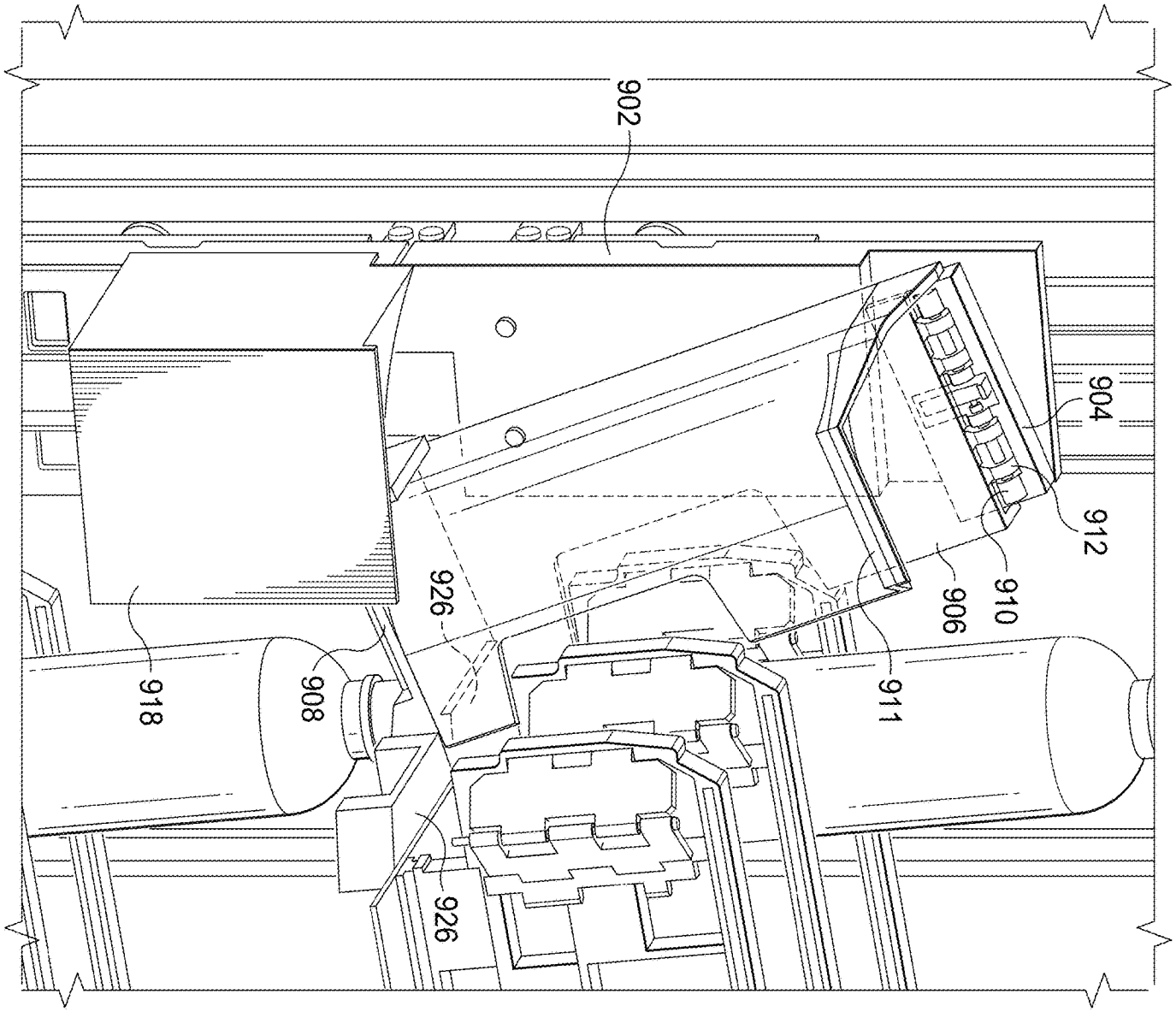
FIG. 9D illustrates a side perspective view of a tilting cup apparatus interacting with a release mechanism of a vending machine according to various embodiments of the present disclosure.

FIG. 9A illustrates a front perspective view of the tilting cup apparatus 900 according to various embodiments of the present disclosure. FIG. 9B illustrates a side perspective view of a motor of the tilting cup apparatus 900 according to various embodiments of the present disclosure. FIG. 9C illustrates a side cross sectional view of a bottom portion of the tilting cup apparatus 900 according to various embodiments of the present disclosure. FIG. 9D illustrates a side perspective view of the tilting cup apparatus 900 interacting with a release mechanism of a vending machine according to various embodiments of the present disclosure.

The tilting cup apparatus 900 includes a frame 902 on which a plate 904 is rotatably coupled. A product catch 906 is attached to the plate 904 via tabs 912 disposed near the top of the product catch 906 on one side. The tabs 912 are installed on a hinge 910 that is secured to the plate 904. A bottom of the product catch 906 is disposed on top of a platform 908. The product catch 906 can be rectangular in shape with three sides closed and one open side for receiving a product from a tray in a vending machine. The product catch 906 can be transparent in some embodiments to allow a user of the vending machine to see the drink being delivered through the product catch 906. However, in other embodiments, the product catch 906 could be opaque.

A ledge 911 at the top of the product catch 906 opposite the hinge 910 can come into contact with a wall or other component within the vending machine as the tilting cup apparatus travels down towards an access port, such as access port 105. When the ledge 911 comes into contact with a wall or other component in the vending machine the tabs 912 of the product catch 906 rotate around the hinge 910, rotating the product catch 906 off and out from the platform 908 to a product ejection position, such as that described with respect to FIG. 5J. The product ejection position causes a product to be swept off the platform 908, where a bottom of the product was resting, by the product catch 906 and into an access port, such as access port 105, for retrieval by a user of the vending machine.

The tilting cup apparatus 900 further includes a rotation motor 916 enclosed within a housing 918 in a bottom portion of the tilting cup apparatus 900 below the platform 908. The rotation motor 916 rotates a gear 920 that meshes with teeth 922 of a plate 924, installed on a side of the platform 908 near the frame 902, as illustrated in FIGS. 9B and 9C. In some embodiments, the plate 924 is not installed on the platform 908, but is simply a part of the platform 908 that extends down to the gear 920.

As the rotation motor 916 rotates the gear 920 meshed with the teeth 922, the gear 920 drives the platform 908 to extend the platform 908 out so that the platform 908 can contact a release mechanism, such as release mechanism 616. FIGS. 9A and 9B illustrates the platform 908 in an initial position. The initial position allows for a product to rest on the platform 908 and travel with the tilting cup apparatus 900, and the initial position also allows the tilting cup apparatus 900 to travel through a vending machine without coming into contact with other components in the vending machine. As the gear 920 rotates across the teeth 922, the platform 908 extends out to a retrieval position, as illustrated in FIGS. 9C and 9D. At the retrieval position 536, the platform 508 can contact a release mechanism 926, which can also be one of release mechanisms 202*a* . . . 202*n* of FIG. 2, or release mechanism 616 of FIGS. 6A-6D. The release mechanism 926 releases a product onto the platform 908. The plate 904 can then be rotated back to the initial position, now holding a product for delivery to a user of the vending machine. The plate 924 provides for product retrieval that is configured to rotate about an X-axis while the hinge 910 rotates about a Z-axis.

As described with respect to FIGS. 9A-9D, various embodiments of the present disclosure provide a rotating platform or shelf. A motor can rotate a gear attached to the shelf bottom. When a motor drives the bottom shelf, the back lip can catch the transparent product catch to allow for the tilting cup position. After returning to an initial position, wherein the shelf surface is horizontal and the product catch surface is vertical, the cup proceeds to the port area (access port) where the existing lip can catch and open the product catch.

Figure 10A:
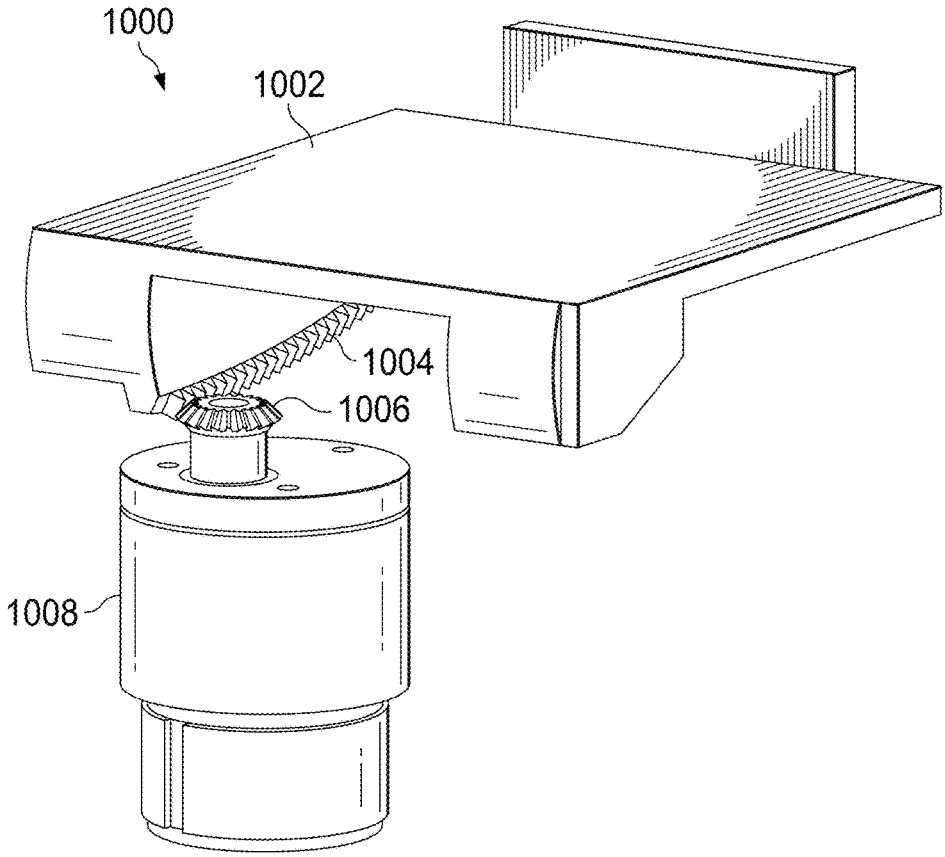
FIG. 10A illustrates a front perspective view of a rotating platform according to embodiments of the present disclosure.
Figure 10B:
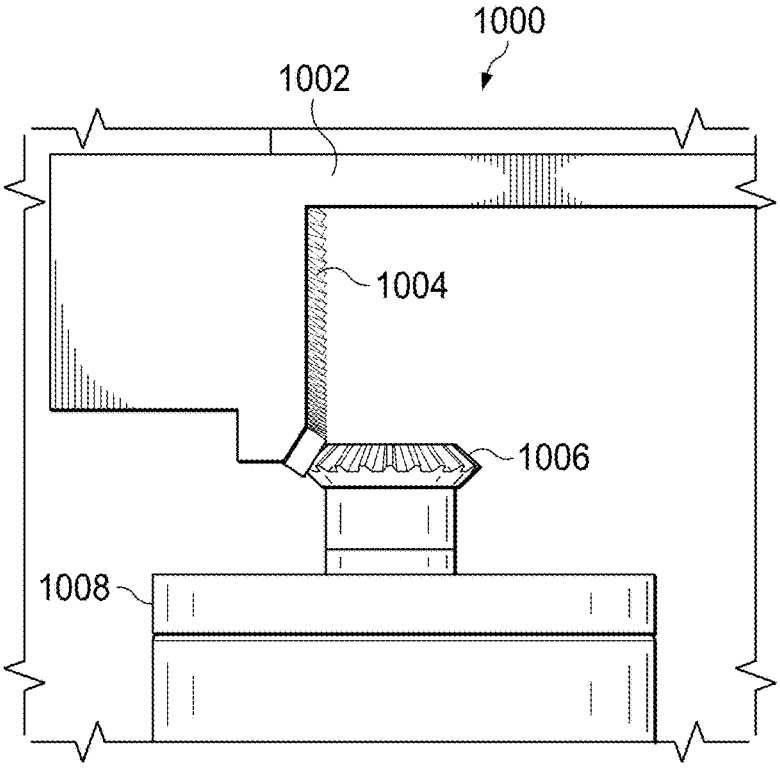
FIG. 10B illustrates a front view of a rotating platform showing a bevel gear of a motor according to embodiments of the present disclosure.

FIGS. 10A and 10B illustrate another embodiment of a rotating platform 1000 according to embodiments of the present disclosure. Rotating platforms can come in a wide variety of configurations, and FIGS. 10A and 10B do not limit the scope of the present disclosure to any particular implementation of a rotating platform. The rotating platform 1000 could be used with the vending machine 100 as shown in FIG. 1, the vending machine 200 as shown in FIG. 2, the tilting cup apparatus 500 as shown in FIGS. 5A-5J, or the tilting cup apparatus 900 as shown in FIGS. 9A-9D, or other tilting cup apparatuses described in the present disclosure.

FIG. 10A illustrates a front perspective view of the rotating platform 1000, according to embodiments of the present disclosure and FIG. 10B illustrates a front view of the rotating platform 1000 showing a bevel gear of a motor according to embodiments of the present disclosure.

The rotating platform 1000 includes a shelf or platform 1002 for receiving and holding a product from a vending machine. An underside of the platform 1002 can include teeth 1004 that can mesh with a bevel gear 1006 of a motor 1008. Alternatively, the teeth 1004 may be included on a gear, plate, or other component coupled to the platform and meshing with the bevel gear 1006 of the motor 1008. The motor 1008 is oriented vertically, allowing the bevel gear 1006 to be positioned below the platform 1002 within a housing of a tilting cup apparatus to engage the teeth 1004 of the platform 1002. As the motor 1008 rotates the bevel gear 1006, the platform 1002 can be rotated forward.

Figure 11A:
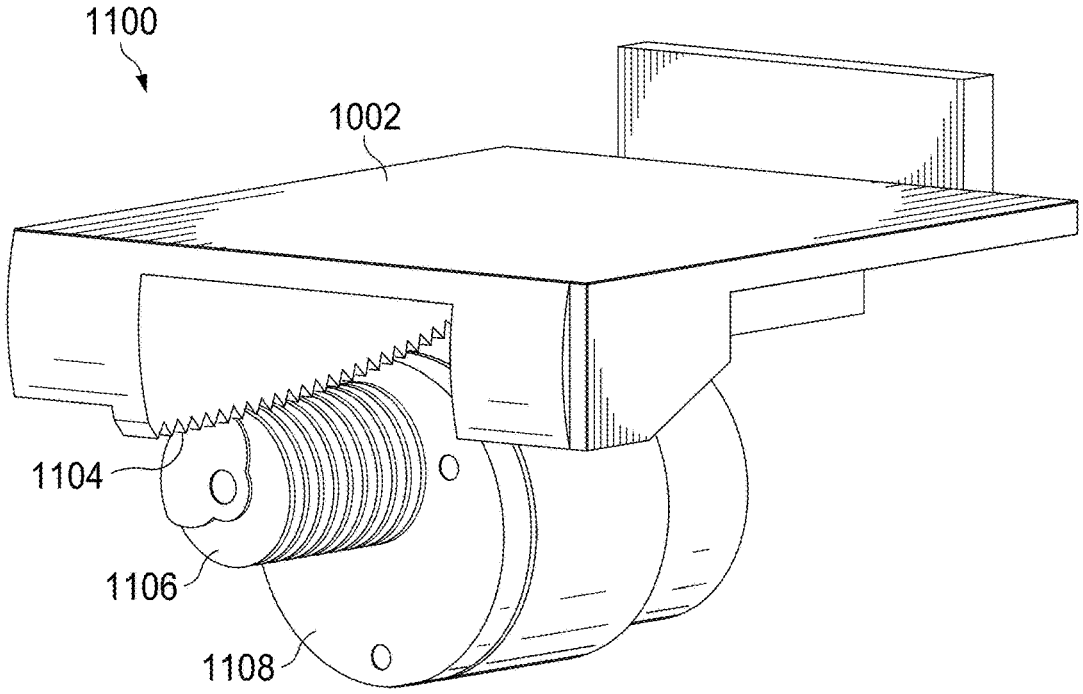
FIG. 11A illustrates a front perspective view of a rotating platform according to embodiments of the present disclosure.
Figure 11B:
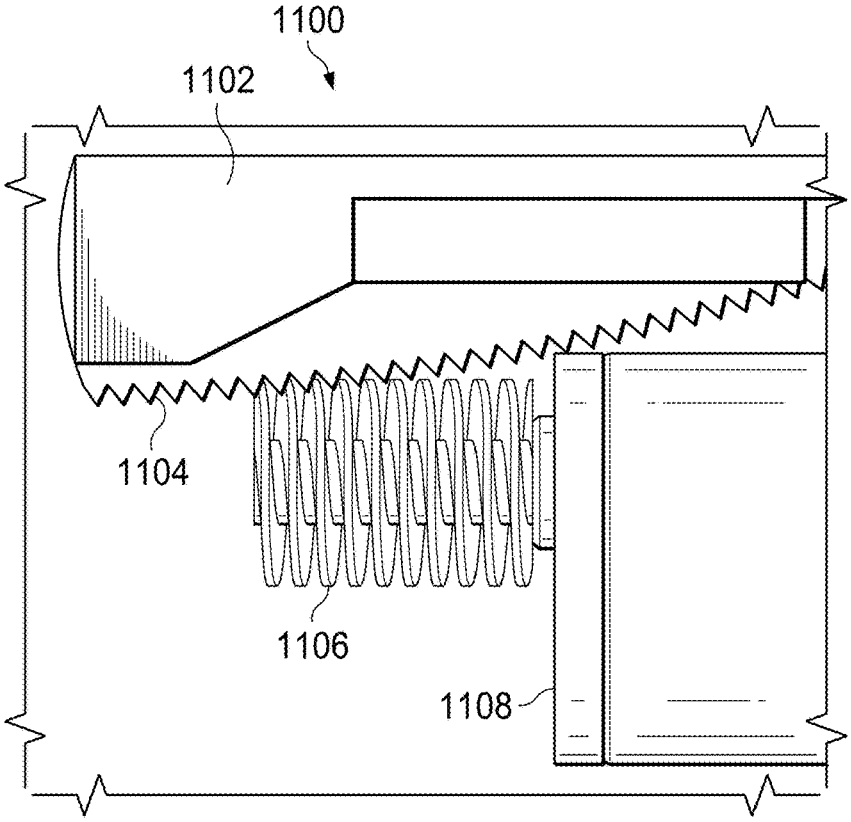
FIG. 11B illustrates a side view of a rotating platform showing a worm gear of a motor according to embodiments of the present disclosure.

FIGS. 11A and 11B illustrate another embodiment of a rotating platform 1100 according to embodiments of the present disclosure. Rotating platforms can come in a wide variety of configurations, and FIGS. 11A and 11B do not limit the scope of the present disclosure to any particular implementation of a rotating platform. The rotating platform 1100 could be used with the vending machine 100 as shown in FIG. 1, the vending machine 200 as shown in FIG. 2, the tilting cup apparatus 500 as shown in FIGS. 5A-5J, or the tilting cup apparatus 900 as shown in FIGS. 9A-9D, or other tilting cup apparatuses described in the present disclosure.

FIG. 11A illustrates a front perspective view of the rotating platform 1100, according to embodiments of the present disclosure and FIG. 11B illustrates a side view of the rotating platform 1100 showing a worm gear of a motor according to embodiments of the present disclosure.

The rotating platform 1100 includes a shelf or platform 1102 for receiving and holding a product from a vending machine. An underside of the platform 1102 includes teeth 1104 that can mesh with a worm gear 1106 of a motor 1108. The motor 1108 is oriented horizontally to allow the worm gear 1106 to be positioned below the platform 1102 within to engage the teeth 1104 of the platform 1102. As the motor 1108 rotates the worm gear 1106, the platform 1102 can be rotated forward. The horizontal motor 1108 and the worm gear 1106 can allow for reduced speeds and a compact apparatus of the rotating platform 1100.

Figure 12C:
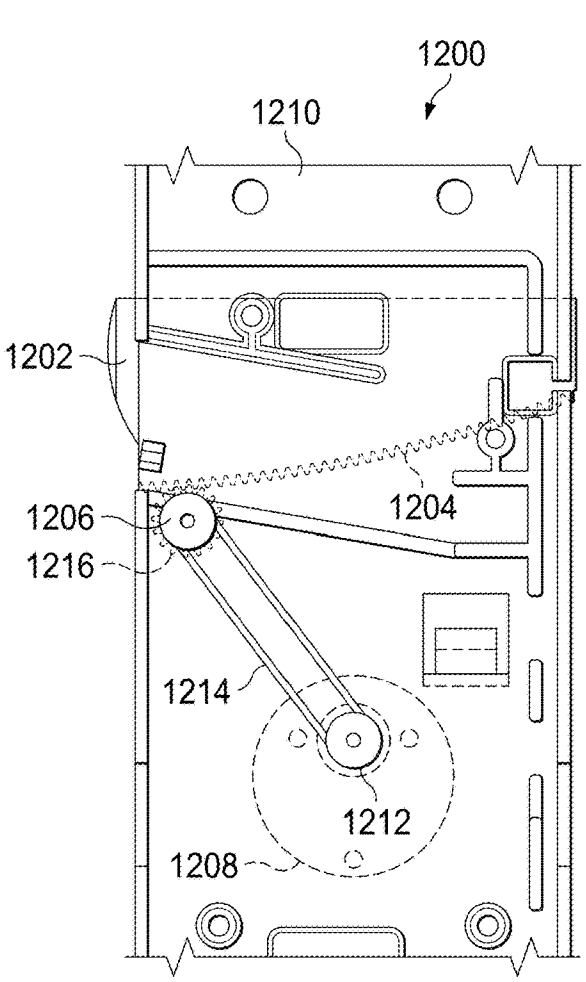
FIG. 12C illustrates a side view of a rotating platform according to embodiments of the present disclosure.
Figure 12B:
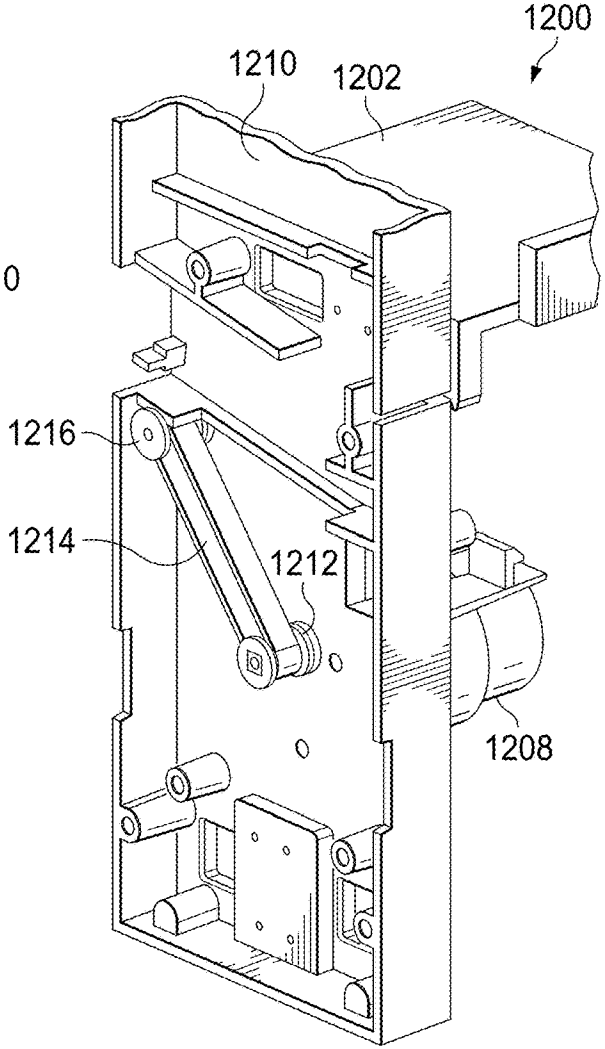
FIG. 12B illustrates a side perspective view of a rotating platform according to embodiments of the present disclosure.
Figure 12A:
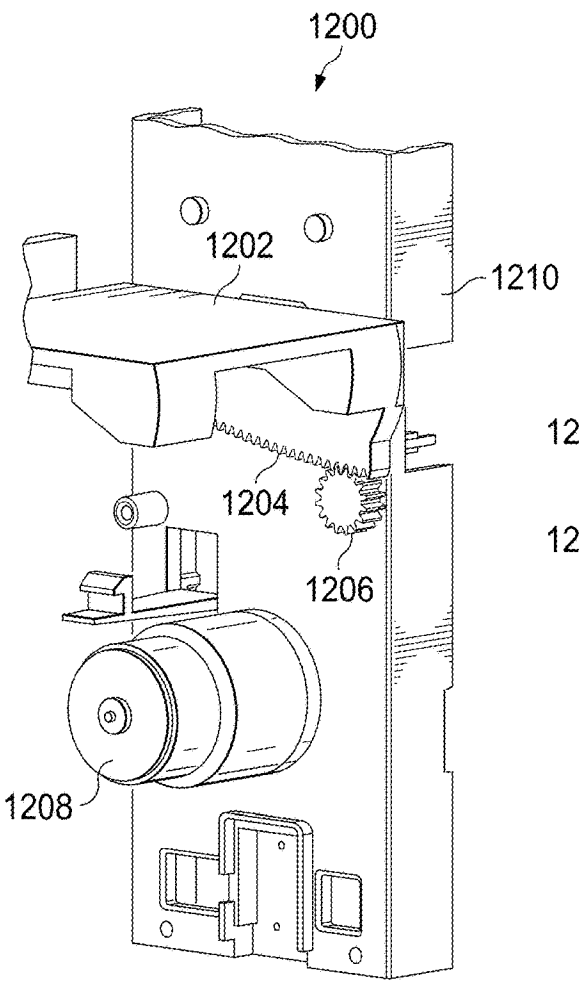
FIG. 12A illustrates a front perspective view of a rotating platform according to embodiments of the present disclosure.

FIGS. 12A-12C illustrate another embodiment of a rotating platform 1200 according to embodiments of the present disclosure. Rotating platforms can come in a wide variety of configurations, and FIGS. 12A-12C do not limit the scope of the present disclosure to any particular implementation of a rotating platform. The rotating platform 1200 could be used with the vending machine 100 as shown in FIG. 1, the vending machine 200 as shown in FIG. 2, the tilting cup apparatus 500 as shown in FIGS. 5A-5J, or the tilting cup apparatus 900 as shown in FIGS. 9A-9D, or other tilting cup apparatuses described in the present disclosure.

FIG. 12A illustrates a front perspective view of the rotating platform 1200, according to embodiments of the present disclosure. FIG. 12B illustrates a side perspective view of the rotating platform 1200 according to embodiments of the present disclosure. FIG. 12C illustrates a side view of the rotating platform 1200 according to embodiments of the present disclosure.

The rotating platform 1200 includes a shelf or platform 1202 for receiving and holding a product from a vending machine. An underside of the platform 1202 includes teeth 1204 that can mesh with a gear 1206. A motor 1208 is oriented horizontally on a frame 1210. The motor 1208 turns a first knob 1212 disposed on the other side of the frame 1210. The first knob 1212 has installed thereon a belt 1214 that loops around the first knob 1212 and around a second knob 1216, the second knob 1216 disposed on an opposite side of the frame 1210 from the gear 1206. The belt can also be made of any suitable material. The belt can be smooth or include teeth configured to engage gears. As the motor 1208 rotates the first knob 1212, the belt 1214 rotates the second knob 1216, causing the gear 1206 to rotate. As the gear 1206 rotates against the teeth 1204 of the platform 1202, the platform 1202 is pushed forward from an initial position into a product retrieval position in order to receive a product.

Figure 13C:
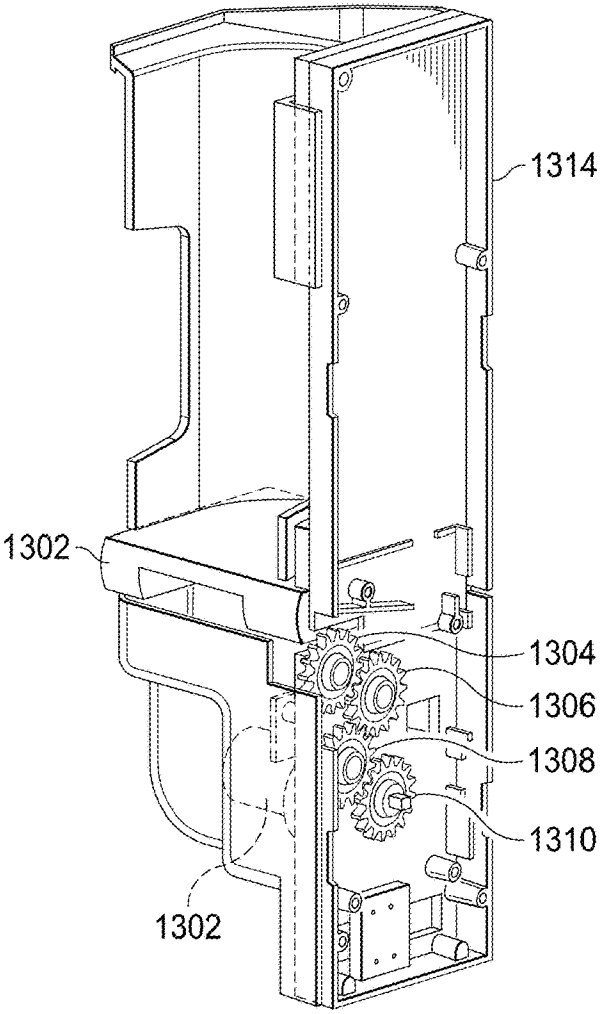
FIG. 13C illustrates a side perspective view of a rotating platform including a series of gears according to embodiments of the present disclosure.
Figure 13B:
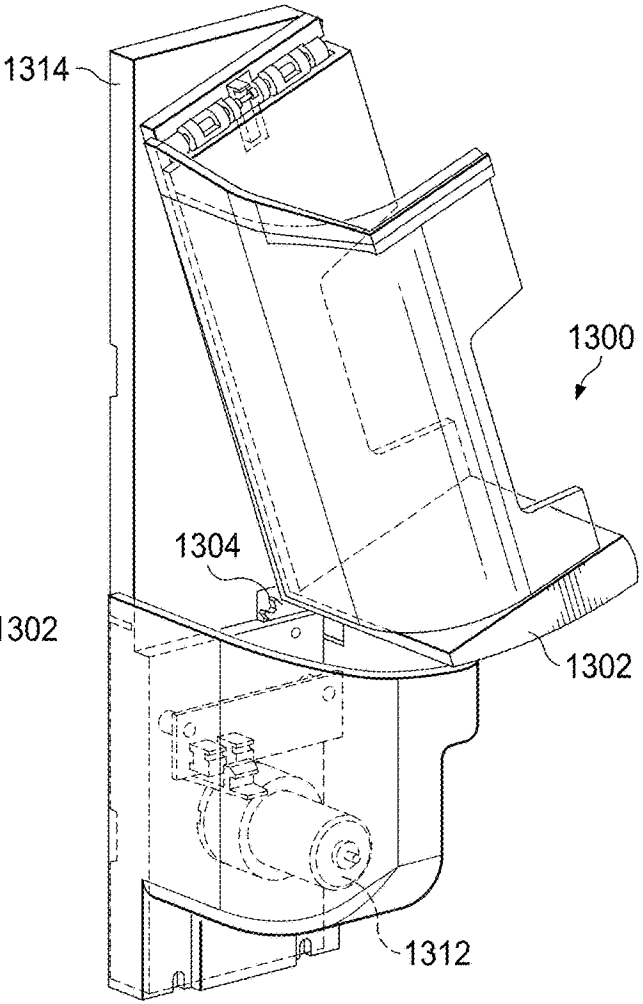
FIG. 13B illustrates a back perspective view of a rotating platform in a product retrieval position according to embodiments of the present disclosure.
Figure 13A:
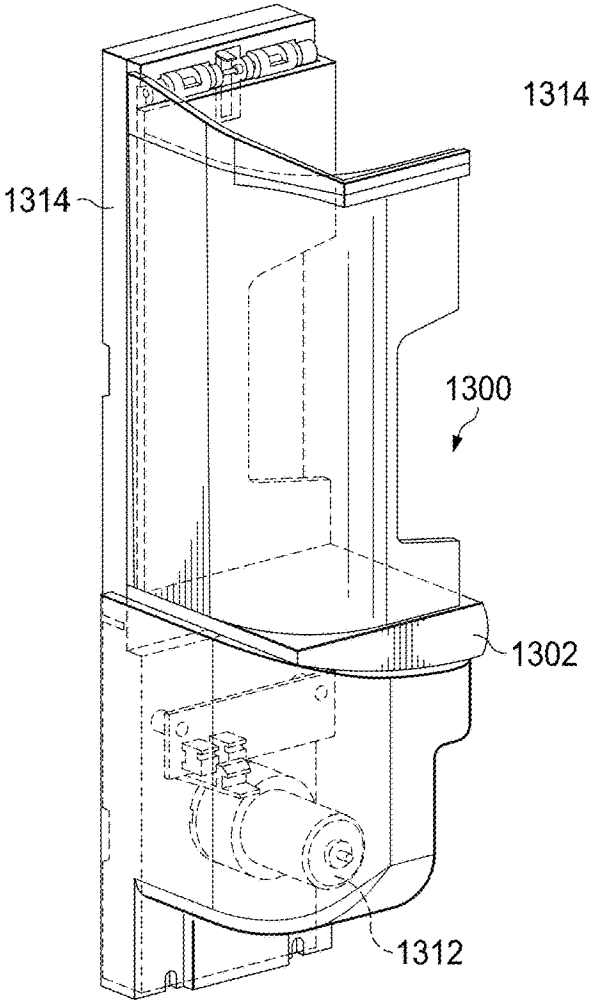
FIG. 13A illustrates a back perspective view of a rotating platform in an initial position according to embodiments of the present disclosure.

FIGS. 13A-13C illustrate another embodiment of a rotating platform 1300 according to embodiments of the present disclosure. Rotating platforms can come in a wide variety of configurations, and FIGS. 13A-13C do not limit the scope of the present disclosure to any particular implementation of a rotating platform. The rotating platform 1300 could be used with the vending machine 100 as shown in FIG. 1, the vending machine 200 as shown in FIG. 2, the tilting cup apparatus 500 as shown in FIGS. 5A-5J, or the tilting cup apparatus 900 as shown in FIGS. 9A-9D, or other tilting cup apparatuses described in the present disclosure.

FIG. 13A illustrates a back perspective view of the rotating platform 1300 in an initial position according to embodiments of the present disclosure. FIG. 13B illustrates a back perspective view of the rotating platform 1300 in a product retrieval position according to embodiments of the present disclosure. FIG. 13C illustrates a side perspective view of the rotating platform 1300 showing a series of gears according to embodiments of the present disclosure.

The rotating platform 1300 includes a shelf or platform 1302 for receiving and holding a product from a vending machine. An underside of the platform 1302 can include teeth that mesh with a first gear 1304 of the series of gears. The first gear 1304 meshes with a second gear 1306 of the series of gears, and the second gear meshes with a third gear 1308 of the series of gears, and the third gear 1308 meshes with a fourth gear 1310 of the series of gears. A motor 1312 is oriented horizontally on a frame 1314. The motor 1312 rotates the fourth gear 1310 disposed on the other side of the frame 1314, the fourth gear 1310 rotating the other gears 1304, 1306, and 1308 in turn. As the first gear 1304 rotates against the teeth of the platform 1302, the platform 1302 is pushed forward from the initial position into a product retrieval position in order to receive a product.

Figure 14C:
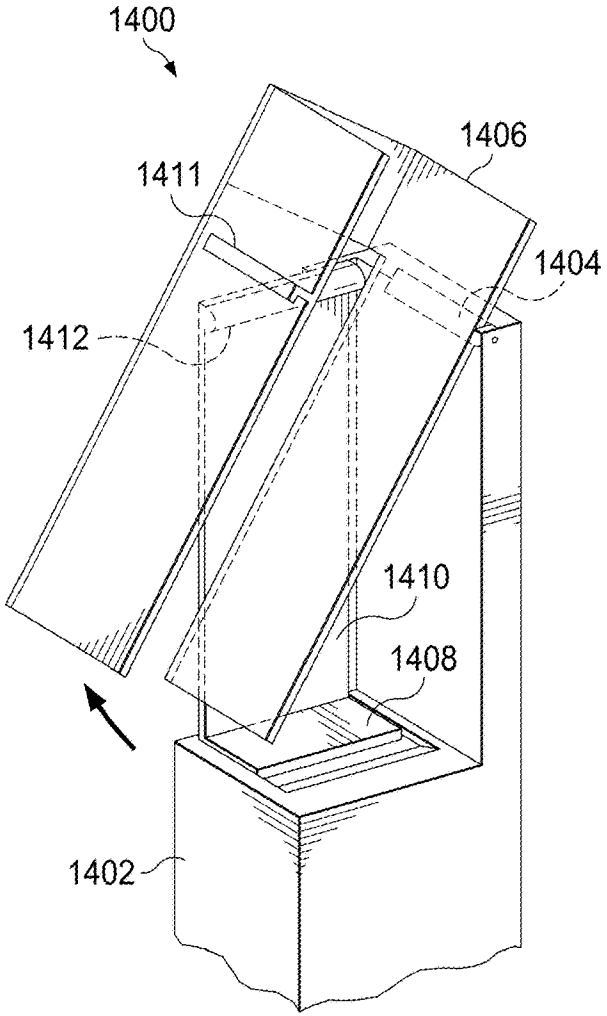
FIG. 14C illustrates a front perspective view of a tilting cup apparatus in a product ejection position according to embodiments of the present disclosure.
Figure 14B:
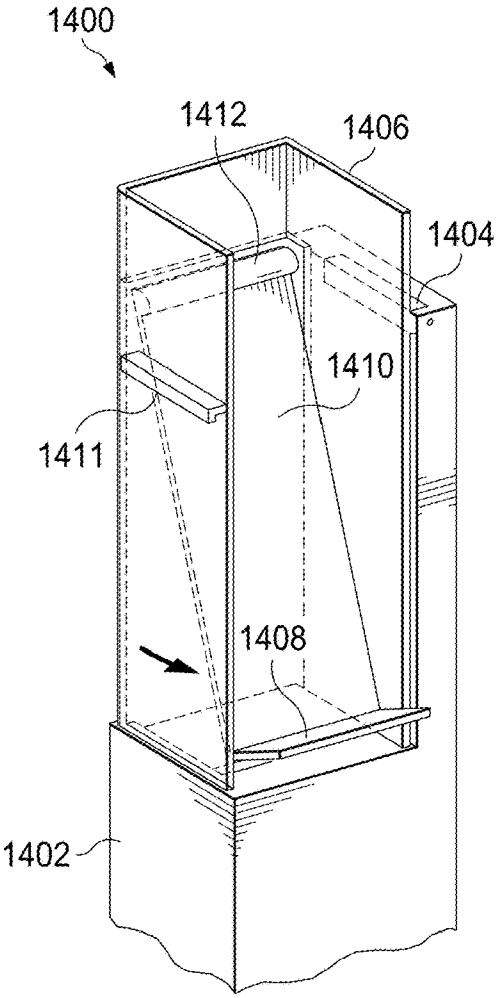
FIG. 14B illustrates a front perspective view of a tilting cup apparatus in a product retrieval position according to embodiments of the present disclosure.
Figure 14A:
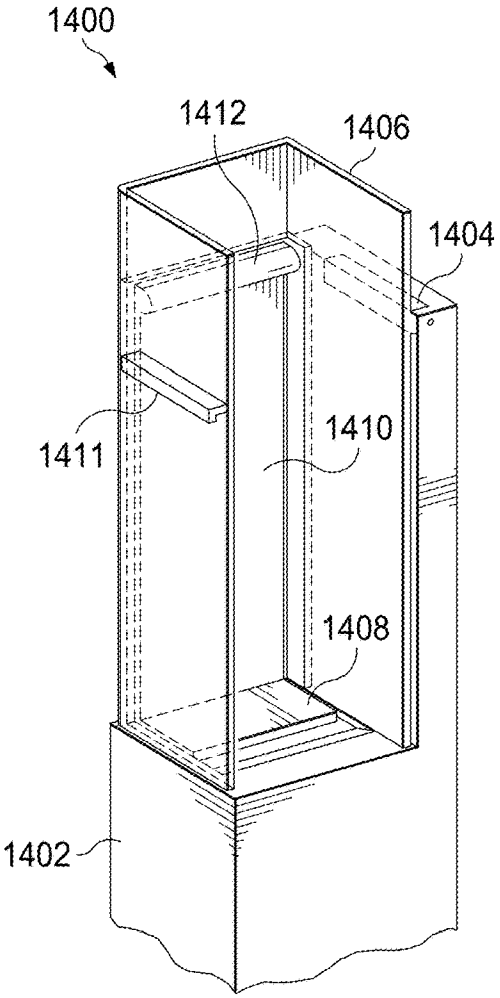
FIG. 14A illustrates a front perspective view of a tilting cup apparatus in an initial position according to embodiments of the present disclosure.

FIGS. 14A-14C illustrate a tilting cup apparatus 1400 with an "L" bracket extension according to embodiments of the present disclosure. Tilting cup apparatuses can come in a wide variety of configurations, and FIGS. 14A-14C do not limit the scope of the present disclosure to any particular implementation of a tilting cup apparatus. The tilting cup apparatus 1400 could be used with the vending machine 100 as shown in FIG. 1, or the vending machine 200 as shown in FIG. 2.

FIG. 14A illustrates a front perspective view of the tilting cup apparatus 1400 in an initial position according to embodiments of the present disclosure. FIG. 14B illustrates a front perspective view of the tilting cup apparatus 1400 in a product retrieval position according to embodiments of the present disclosure. FIG. 14C illustrates a front perspective view of the tilting cup apparatus 1400 in a product ejection position according to embodiments of the present disclosure.

The tilting cup apparatus 1400 includes a frame 1402 on which a product catch 1406 is rotatably connected to the frame 1402 by a hinge 1404. The product catch 1406 can rotate via the hinge 1404 from a resting position shown in FIG. 14A to a product ejection position shown in FIG. 14C. A ledge 1411 on a side of the product catch 1406 opposite the hinge 1404 can come into contact with a ledge or other component within the vending machine as the tilting cup apparatus 1400 travels down towards an access port, such as access port 105. When the ledge 1411 comes into contact with a ledge or other component in the vending machine, the hinge 1404 activates and rotates to a product ejection position, as shown in FIG. 14C. The product ejection position causes the product catch 1406 to sweep a product off a platform 1408 into an access port, such as access port 105.

The platform 1408 can act at as at least part of abase of an "L" bracket 1410. The product catch 1406 can be rectangular in shape with two sides closed and two side open, the front and back sides being the open sides. The product catch 1406 can be transparent in some embodiments to allow a user of the vending machine to see the drink being delivered through the product catch 1406. However, in other embodiments, the product catch 1406 could be opaque.

The open front side allows for receipt of a product from a tray in a vending machine onto the platform 1408 of the "L" bracket 1410. The "L" bracket 1410 is rotatably connected to the frame 1402 via a hinge 1412 at a top of the tilting cup apparatus 1400. The "L" bracket 1410 can rotate via the hinge 1412 to extend from the initial position into a product retrieval position, extending to a product tray to retrieve a product from a vending machine. In the initial position, the "L" bracket 1410 can reside within the back open wall of the product catch 1406, such that the product catch 1406 passes by the "L" bracket 1410 when the product catch 1406 rotates to the product ejection position, as shown in FIG. 14C. The tilting of the "L" bracket 1410 can be created by utilizing a number of electro-mechanical mechanisms including a motor and gear, motor and belt, solenoid, and other types of motors and linkages, such as those described in the present disclosure. These mechanisms are attached to the "L" bracket 1410 and create motion that allows the "L" bracket 1410 to rotate about the hinge 1412.

Figure 15A:
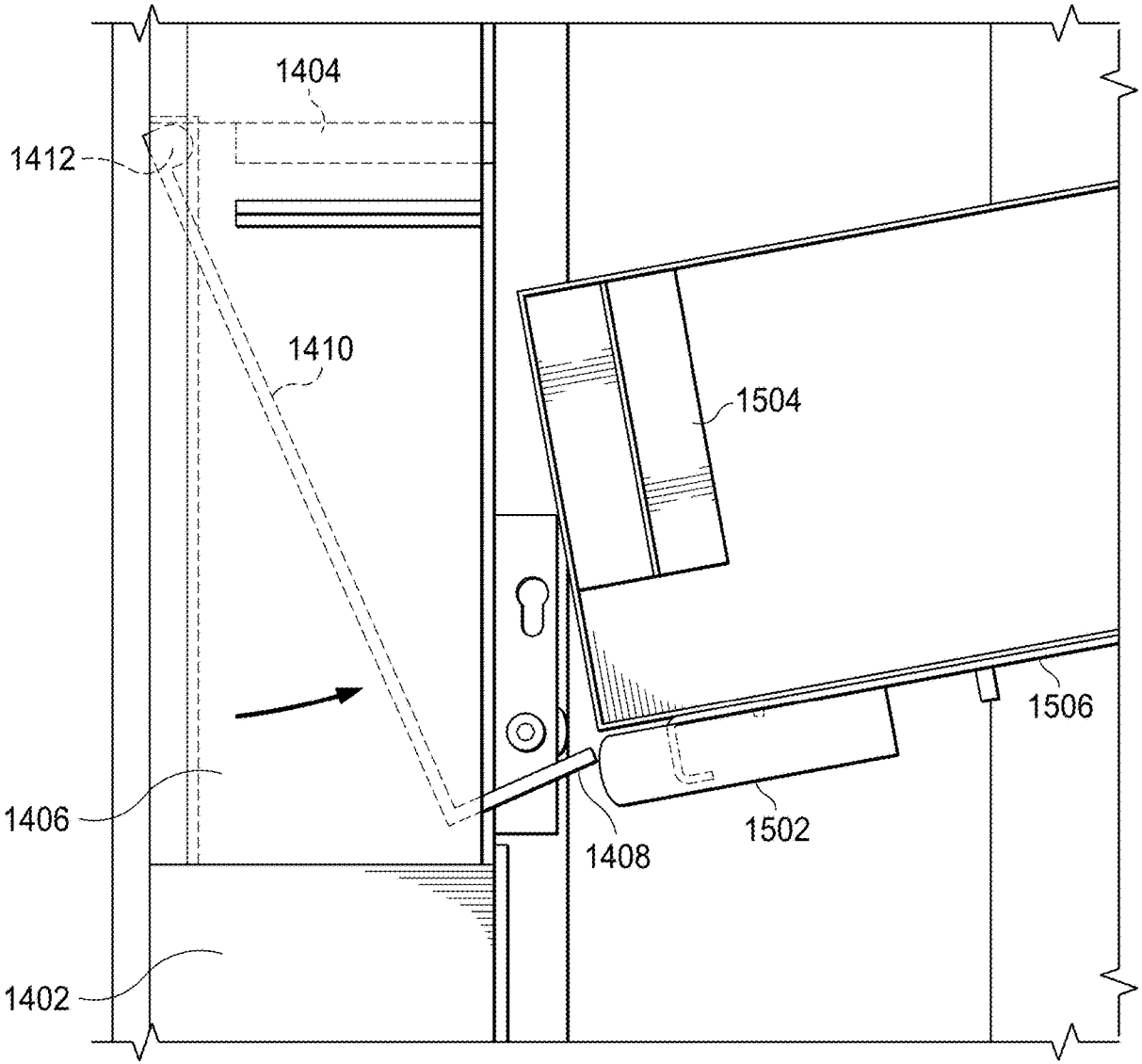
FIG. 15A illustrates a tilting cup apparatus in a product retrieval position according to embodiments of the present disclosure.
Figure 15B:
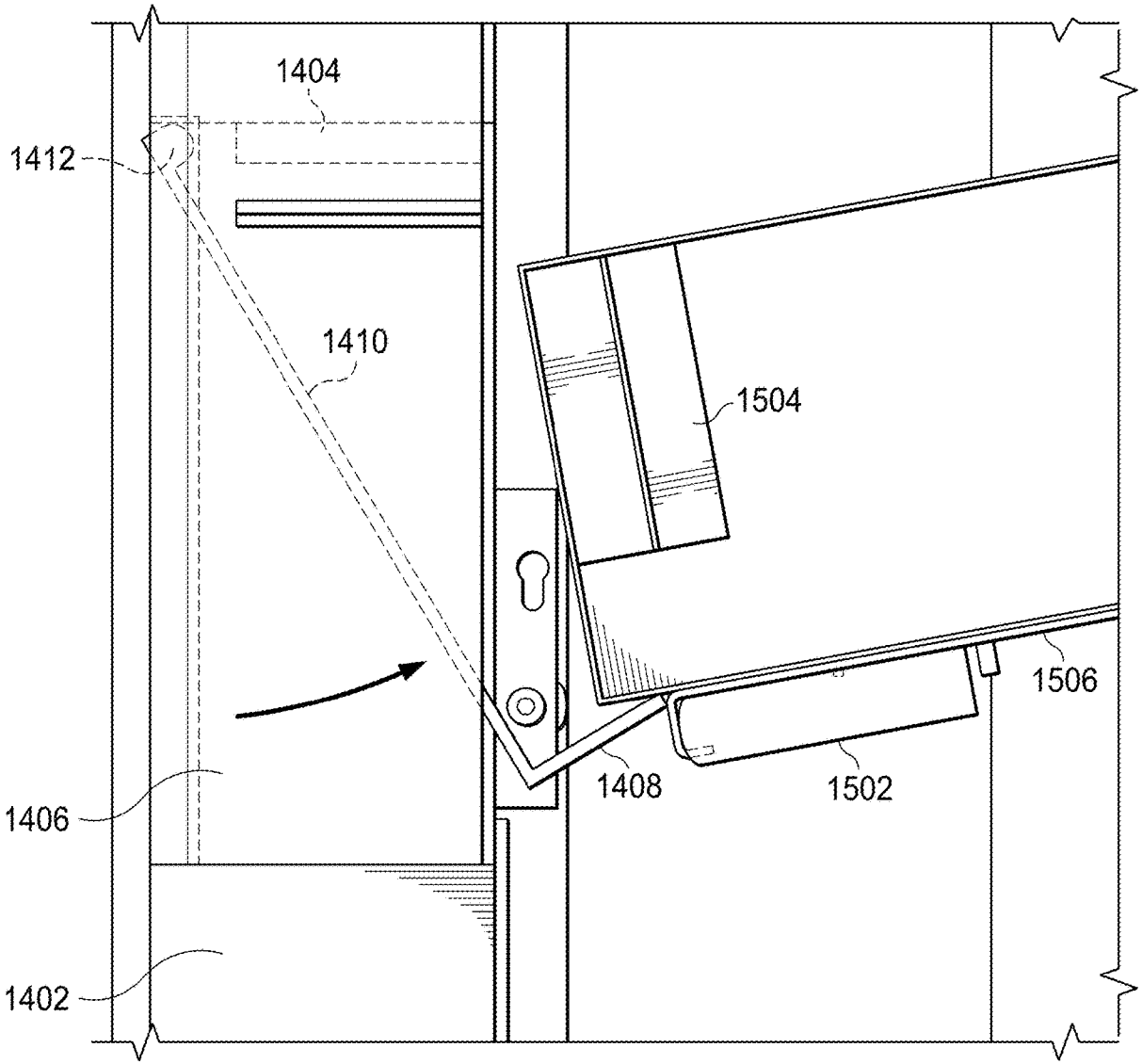
FIG. 15B illustrates a tilting cup apparatus in a product retrieval position and depressing a release mechanism according to embodiments of the present disclosure.

FIGS. 15A and 15B illustrate the tilting cup apparatus 1400 in the product retrieval position and depressing a release mechanism 1502 according to embodiments of the present disclosure. Tilting cup apparatuses and release mechanisms can come in a wide variety of configurations, and FIGS. 15A and 15B do not limit the scope of the present disclosure to any particular implementation of a tilting cup apparatus or a release mechanism. The tilting cup apparatus 1400 and the release mechanism 1502 could be used with the vending machine 100 as shown in FIG. 1, or the vending machine 200 as shown in FIG. 2.

FIG. 15A illustrates the tilting cup apparatus 1400 in a product retrieval position according to embodiments of the present disclosure. FIG. 15B illustrates the tilting cup apparatus 1400 in a product retrieval position and depressing the release mechanism 1502 according to embodiments of the present disclosure.

At the product retrieval position, the platform 1408 of the tilting cup apparatus 1400 can contact the release mechanism 1502. The release mechanism can be similar to release mechanisms 202*a* . . . 202*n* of FIG. 2, or the release mechanism 616 of FIGS. 6A-6D. The gates 1504, when closed, restrict one or more products from sliding off a tray 1506. Depressing the release mechanism 1502 opens gates 1504 to release a product onto the platform 1408 of the tilting cup apparatus 1400. The "L" bracket 1410 can then be rotated back to the initial position, now holding a product for delivery to a user of the vending machine.

Figure 16:
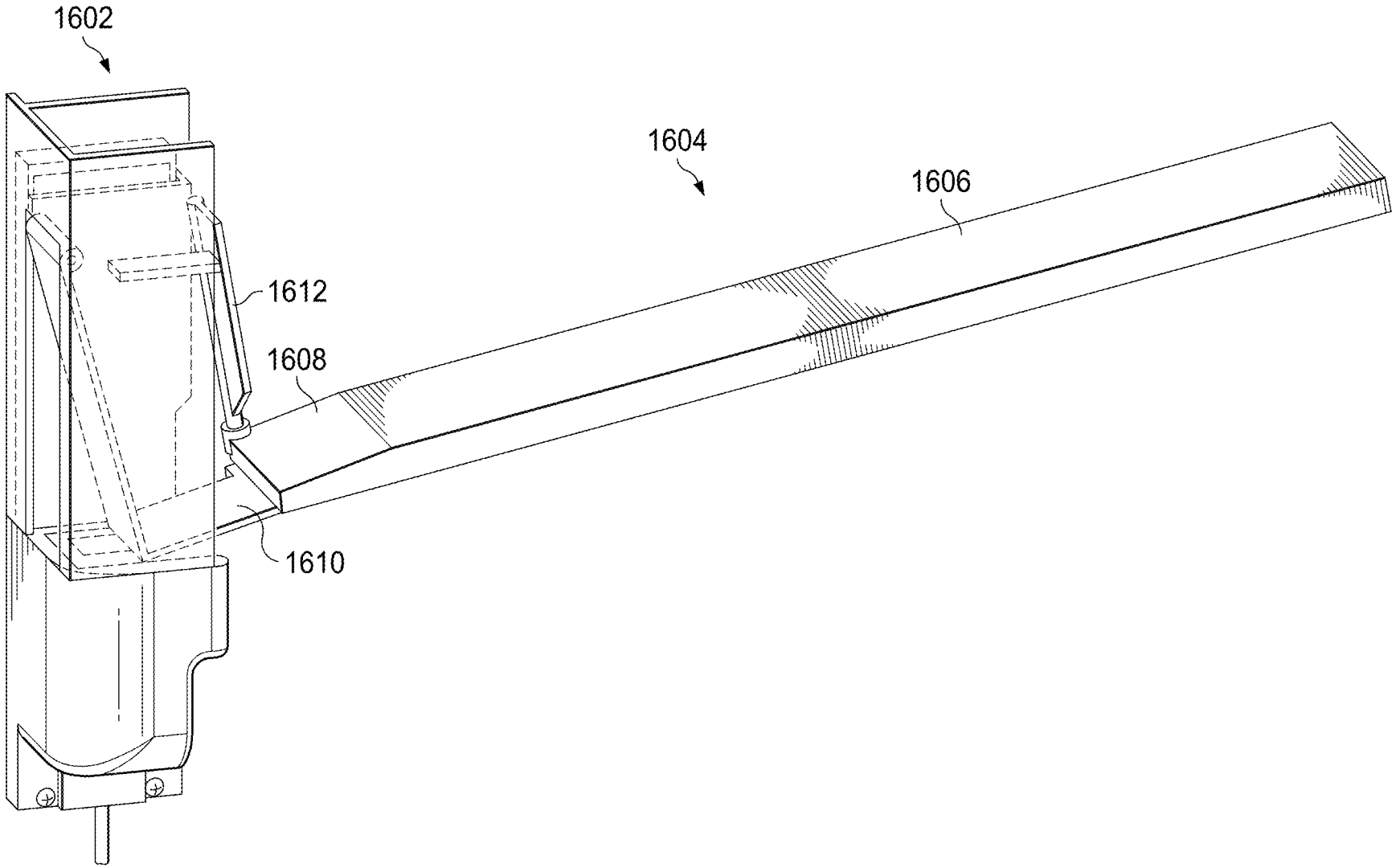
FIG. 16 illustrates a tilting cup apparatus with a product column according to various embodiments of the present disclosure.

FIG. 16 illustrates a tilting cup apparatus 1602 with a product column 1604 according to various embodiments of the present disclosure. Tilting cup apparatuses and product columns can come in a wide variety of configurations, and FIG. 16 does not limit the scope of the present disclosure to any particular implementation of a tilting cup apparatus or a product column. The tilting cup apparatus 1602 and/or the product column 1604 could be used with the vending machine 100 as shown in FIG. 1, or the vending machine 200 as shown in FIG. 2.

In a vending machine, it is desirable for the product to smoothly transition from a product column to the cup. Part of the transition is movement along the product column. The product column 1604 includes a high friction zone 1606 that can hold a plurality of products thereon. The high friction zone 1606 can include a high friction material or textures/patterns that resist bottle advancement due to tray angle. The high friction zone can be positioned along most of the product column, except for the portion near the cup, where a low friction zone 1608 can be positioned. The low friction zone 1608 can be at a greater angle than the high friction zone 1606 to encourage a product released for retrieval by the tilting cup apparatus 1602 to quickly exit the product column 1604. For example, in some embodiments, the high friction zone 1606 can be at a 10 degree angle and the low friction zone 1608 can be at a 15 degree angle. The low friction zone 1608 can include a polyoxymethylene material to provide less friction in the low friction zone 1608 to allow products to more quickly slide across the low friction zone 1608. The low friction zone 1608 can be also be made of, for example, but not limited to, polytetrafluoroethylene, ultra-high-molecular-weight polyethylene, or nylon.

In some embodiments, the tilting cup apparatus 1602 can include an "L" bracket 1610, such as that described with respect to FIGS. 14A-14C, and FIGS. 15A and 15B. The "L" bracket 1610 rotates forward to depress a release mechanism, which can open a gate 1612 to release a product from the product column 1604. However, in some embodiments, the tilting cup apparatus 1602 can include a rotating shelf or platform such as that described with respect to FIGS. 5A-5J or as described with respect to other embodiments of the present disclosure. A damped pusher plate combined with the tilting cup apparatus 1602 allows for a smooth transition from the column to the cup.

Figure 17B:
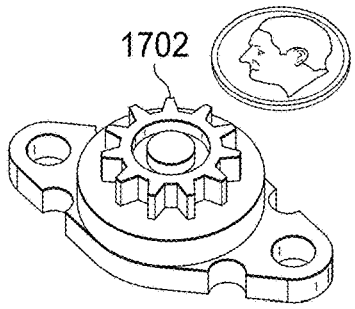
FIG. 17B illustrates a top perspective view of a rotational damper according to embodiments of the present disclosure.
Figure 17A:
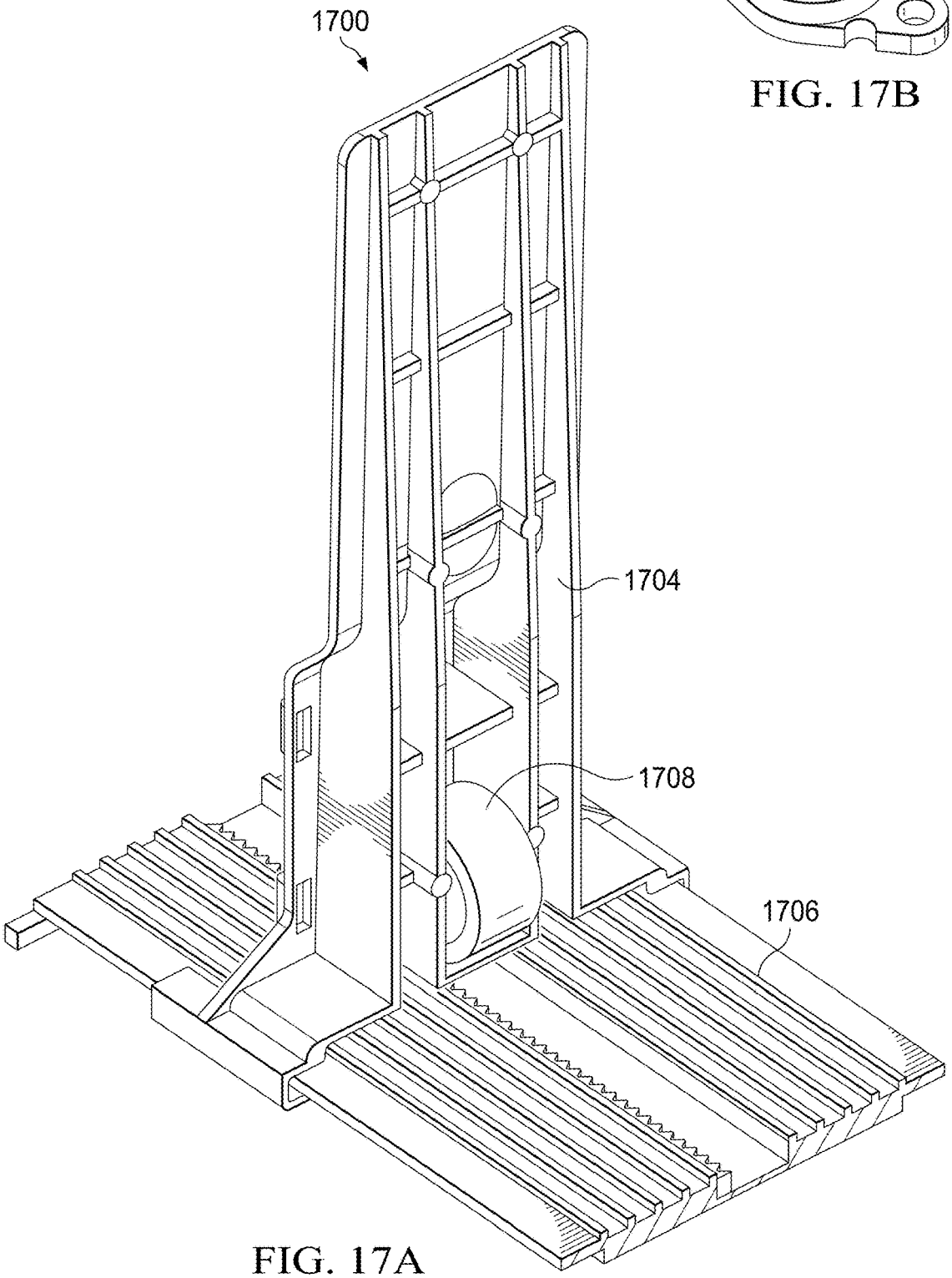
FIG. 17A illustrates a front perspective view of a damped pusher plate installed on a product column according to embodiments of the present disclosure.

FIGS. 17A and 17B illustrate a pusher slide assembly 1700 and a rotational damper 1702 according to embodiments of the present disclosure. Pusher slide assemblies and rotational dampers can come in a wide variety of configurations, and FIGS. 17A and 17B do not limit the scope of the present disclosure to any particular implementation of a pusher slide assembly or a damped pusher. The pusher slide assembly 1700 and/or the rotational damper 1702 could be used with the vending machine 100 as shown in FIG. 1, or the vending machine 200 as shown in FIG. 2.

FIG. 17A illustrates a front perspective view of a damped pusher plate 1704 installed on a product tray 1706 according to embodiments of the present disclosure. FIG. 17B illustrates a top perspective view of a rotational damper 1702 according to embodiments of the present disclosure.

In various embodiments, a damped pusher plate 1704 installed on a product tray 1706 can include a spring force increased to a limit of product loading feasibility. The rotational damper 1702 can be added to slow the advancement of the pusher plate 1704 and the product tray 1706 when vending. When using a pusher plate 1704 as described in the present disclosure, a spring 1708 can be loaded with different levels of force. The spring 1708 can be loaded with a high level of force to provide more torque to the pusher plate 1704, or a low level of force to provide a lower torque to the pusher plate 1704. The more force, the easier it is for the pusher plate 1704 to move the products down the product tray 1706. Additionally, an angled tray can provide gravitational support to the pusher plate 1704 for movement of the product down the product tray 1706. The greater the force of the spring 1708, the less angled the tray 1706 can be to provide enough force to move the product down the tray 1706.

One or more embodiments of the present disclosure provide a pusher plate 1704 with a spring 1708 including a high level of force. To reduce the speed and acceleration of the pusher plate 1704 during a vending action, the pusher plate 1704 can also include the rotational damper 1702. The different embodiments of the present disclosure recognize and take into account that it is desirable to have a smooth transition of product down the tray 1706 and into the cup. A high acceleration and speed of the pusher plate 1704 during a vending action can cause undesirable shaking or otherwise abrupt movement of the product during the vending action. In some embodiments, the product tray 1706 can also have high and low friction zones such as that described with respect to FIG. 16.

Figure 18A:
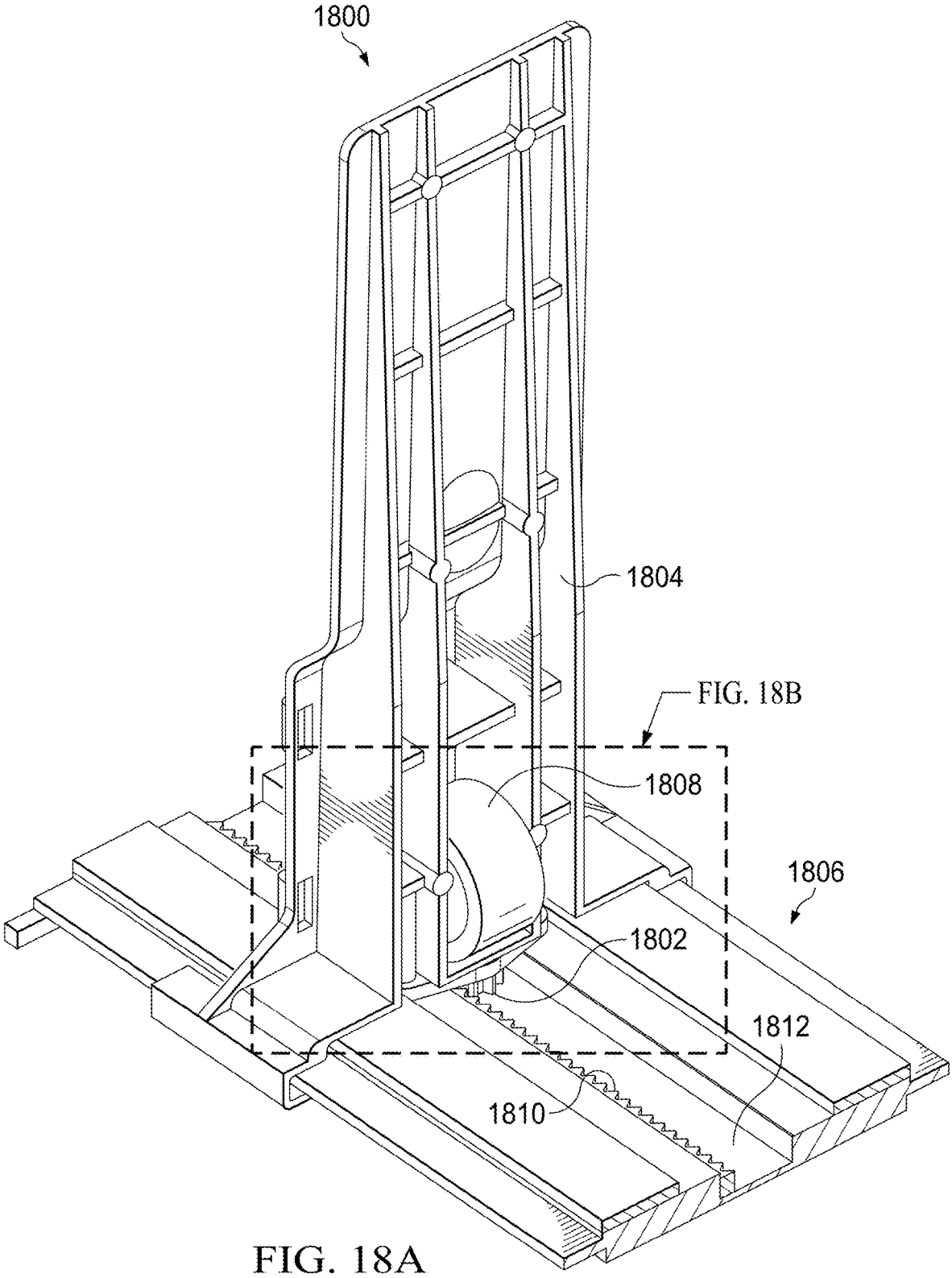
FIG. 18A illustrates a top perspective view of a gear damper assembly according to embodiments of the present disclosure.
Figure 18B:
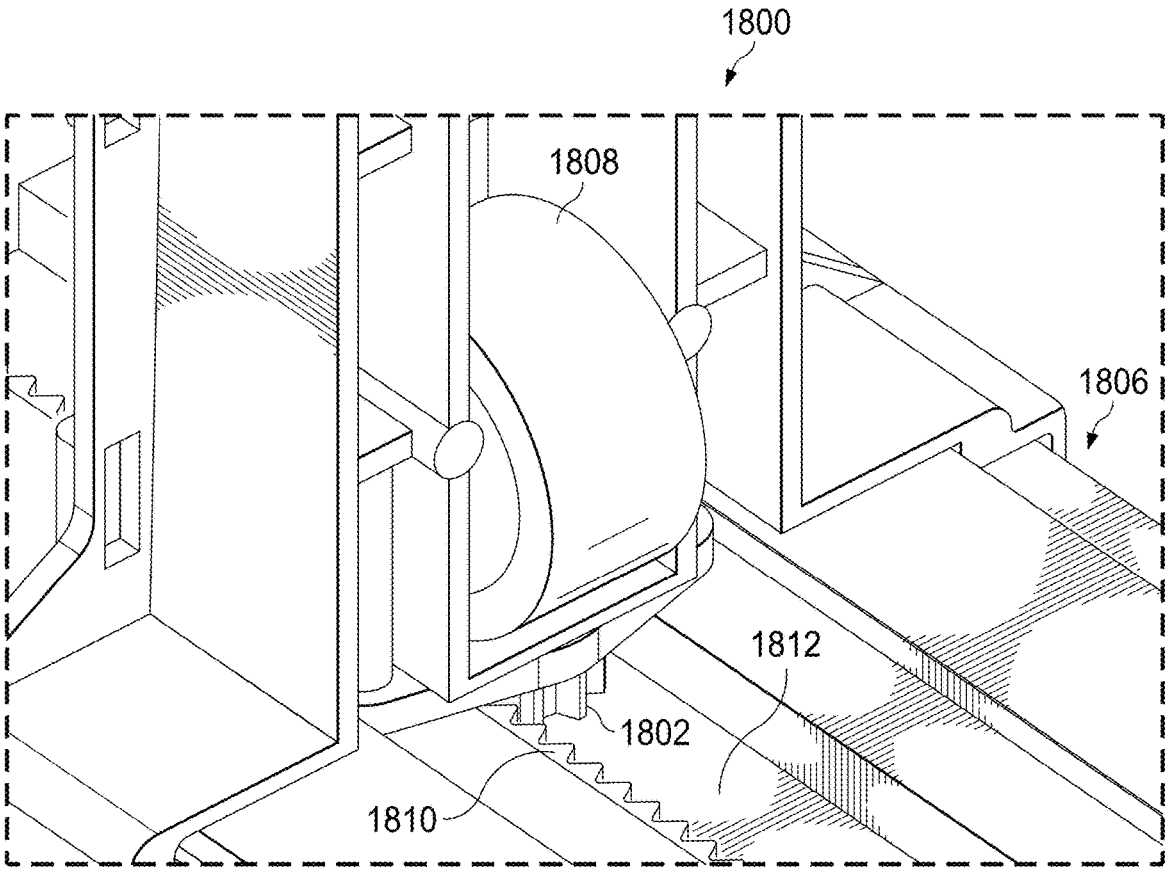
FIG. 18B illustrates a side perspective view of a gear damper assembly according to embodiments of the present disclosure.
Figure 18C:
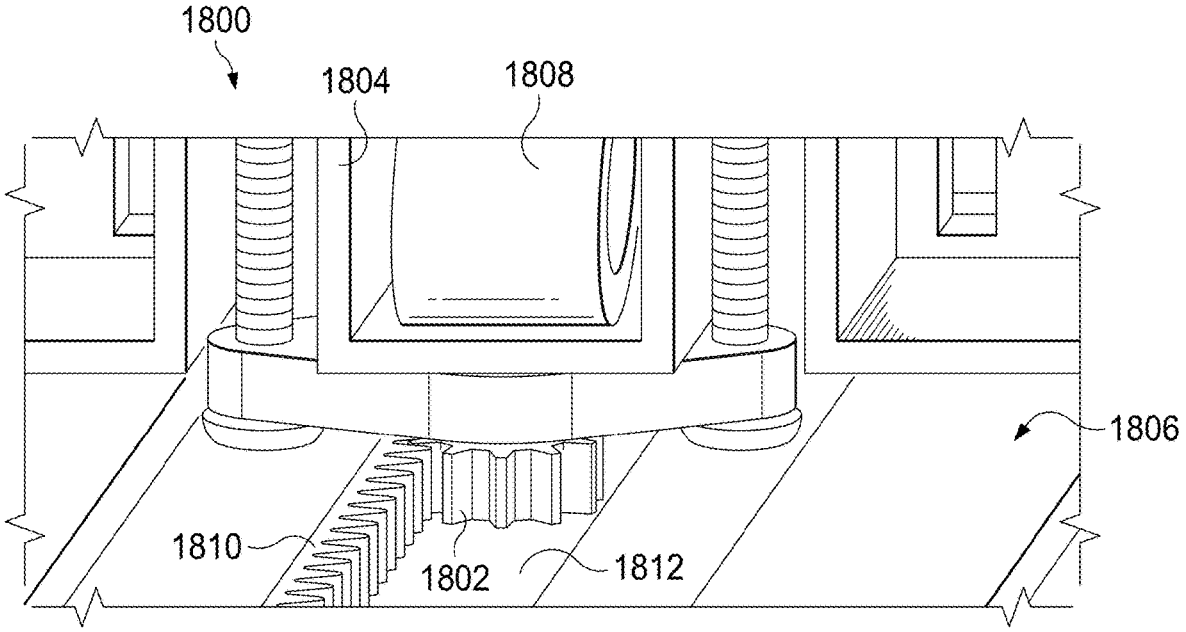
FIG. 18C illustrates a front view of a gear damper assembly according to embodiments of the present disclosure.

FIGS. 18A-18C illustrate a gear damper assembly 1800 according to embodiments of the present disclosure. Gear damper assemblies can come in a wide variety of configurations, and FIGS. 18A-18C do not limit the scope of the present disclosure to any particular implementation of a gear damper assembly. The gear damper assembly 1800 could be used with the vending machine 100 as shown in FIG. 1, or the vending machine 200 as shown in FIG. 2.

FIG. 18A illustrates a top perspective view of the gear damper assembly 1800 according to embodiments of the present disclosure. FIG. 18B illustrates a side perspective view of the gear damper assembly 1800 according to embodiments of the present disclosure. FIG. 18C illustrates a front view of the gear damper assembly 1800 according to embodiments of the present disclosure.

The gear damper assembly 1800 includes a gear damper 1802 installed on a pusher plate 1804, the pusher plate 1804 installed on a product tray 1806. A spring 1808 can be installed on the pusher plate 1804 to provide force to push products along the product tray 1806. The spring 1808 can be uncoiled within a track of the product tray 1806. During operation, the spring 1808 can re-coil to pull the pusher plate 1804 towards the front of the product tray 1806. The gear damper 1802 can provide for decreased speed and acceleration of the pusher plate 1804 by increasing the torque used to move the pusher plate 1804. The gear damper 1802 can be a rotational gear with a material inside that slows the rotation of the gear. For example, the interior of the damper 1802 could include high-density silicon. During rotation, the silicon interacts with the interior of the damper to slow the rotation of the damper 1802, and therefore slow the advancement of the pusher plate 1804. The damper 1802 can also be a pinion gear that engages molded rack geometry 1810 on the product tray 1806. As illustrated in FIGS. 18A-18C, the damper 1802 can be mounted in a horizontal orientation, with the gear damper 1802 disposed within a recessed lane 1812 of the product tray 1806. The molded rack geometry 1810 can be disposed on either side of the recessed lane 1812. As the pusher plate 1804 moves along the product tray 1806, the gear damper 1802 interacts with the molded rack geometry 1810 to slow the movement of the pusher plate 1804. When using a constant force spring, the damper 1802 can be applied as a barrel within the spring 1808, at its axis, to resist spring rotation during uncoiling.

The rotational damper 1802 can be added to the gear damper assembly 1800 to allow for high pushing forces without rapid ejection. This provides time for a front gate to re-engage with the product tray 1806, without a secondary gate or separator system, after the product has moved past the gate. By lowering a shelf angle, adding a gear damper 1802 to the pusher plate 1804 and gear rack 1810 to the tray 1806, the speed that the pusher plate 1804 moves down the tray can be reduced. In some embodiments, the product tray 1806 can also have high and low friction zones such as that described with respect to FIG. 16.

Figure 19:
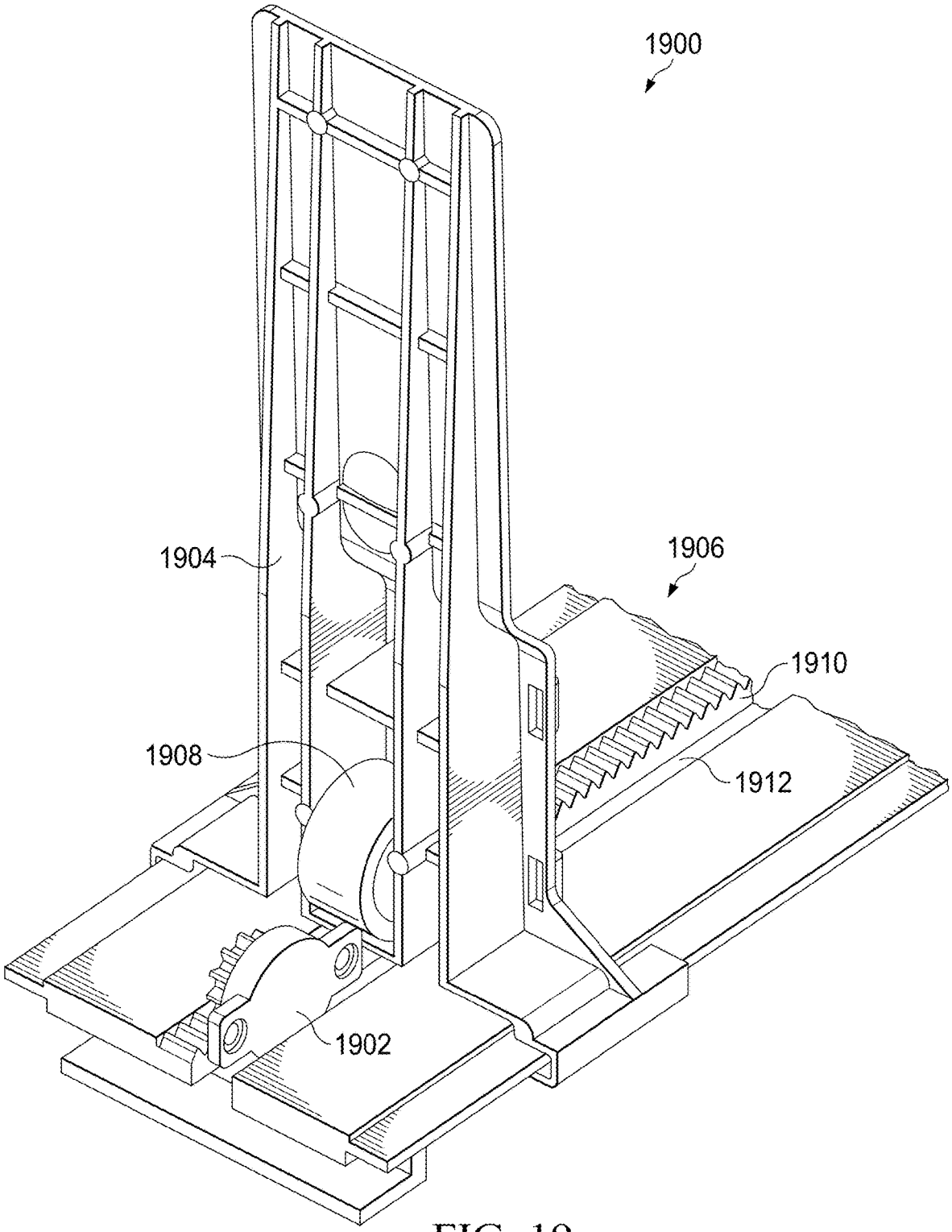
FIG. 19 illustrates a side perspective view of a vertical mounting of a gear damper assembly according to embodiments of the present disclosure.

FIG. 19 illustrates a side perspective view of a vertical mounting of a gear damper assembly 1900 according to embodiments of the present disclosure. Gear damper assemblies can come in a wide variety of configurations, and FIG. 19 does not limit the scope of the present disclosure to any particular implementation of a gear damper assembly. The gear damper assembly 1900 could be used with the vending machine 100 as shown in FIG. 1, or the vending machine 200 as shown in FIG. 2.

The gear damper assembly 1900 includes a gear damper 1902 and a pusher plate 1904 installed on a product tray 1906. The pusher plate 1904 has a spring 1908 installed thereon to provide a movement force to the pusher plate 1904. The product tray 1906 can include a recessed lane 1912 having molded rack geometry 1910. In FIG. 19, the molded rack geometry 1910 includes teeth that are disposed up from the product tray 1906. A side of the gear damper 1902 is disposed within the recessed lane 1912 such that the gear or teeth of the gear damper 1902 face, and mesh with, the molded rack geometry 1910 on one side of the recessed lane 1912.

Figure 20:
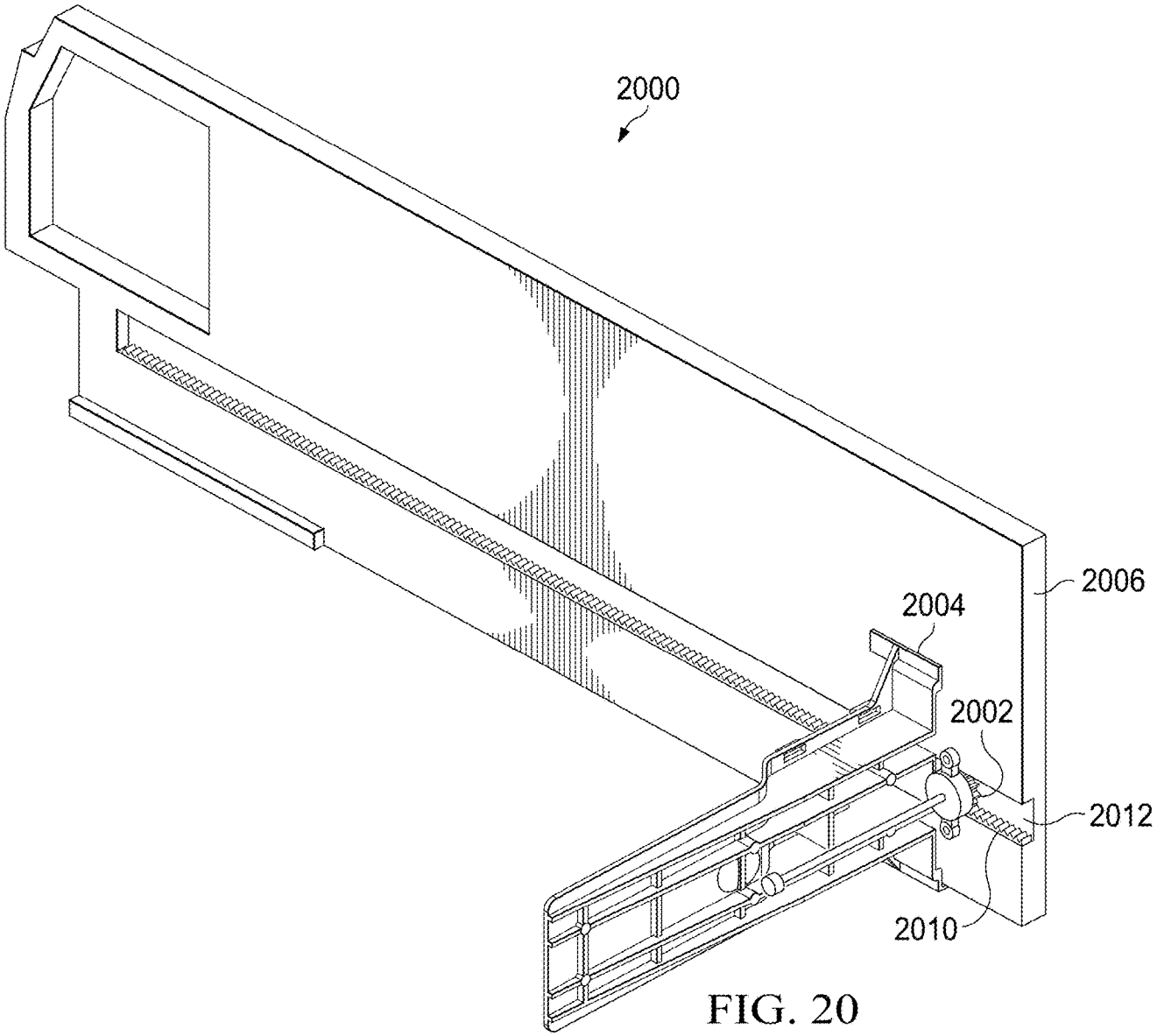
FIG. 20 illustrates a side mounting of a gear damper assembly according to embodiments of the present disclosure.

FIG. 20 illustrates a side mounting of a gear damper assembly 2000 according to embodiments of the present disclosure. Gear damper assemblies can come in a wide variety of configurations, and FIG. 20 does not limit the scope of the present disclosure to any particular implementation of a gear damper assembly. The gear damper assembly 2000 could be used with the vending machine 100 as shown in FIG. 1, or the vending machine 200 as shown in FIG. 2.

The gear damper assembly 2000 includes a gear damper 2002 and a pusher plate 2004 installed on a sidewall 2006 of a product tray. The pusher plate 2004 can have a spring installed thereon to provide a movement force to the pusher plate 2004. The sidewall 2006 can include a recessed lane 2012 having rack geometry 2010. The rack geometry 2010 can include teeth oriented into the recessed lane 2012. Sides of the gear damper 2002 are disposed within the recessed lane 2012 such that teeth of the gear damper 2002 face, and mesh with, the rack geometry 2010 on both sides of the recessed lane 2012. The pusher plate 2004 extends sideways from the sidewall 2006 such that the pusher plate 2004 is disposed above the product tray. As the pusher plate 2004 travels along the sidewall 2006, the pusher plate 2004 contacts products on the product tray to push the products towards a front of the product tray for dispensing within a vending machine.

One or more example embodiments provide a vending machine, comprising an access port, a chassis including a plurality of trays and a plurality of columns, a movable stage, a product catch coupled to the movable stage, wherein the product catch is operable to move in a first direction to accept a product from one of the plurality of trays, and wherein the product catch is operable to move in a second direction to deposit the product in the access port.

In one or more of the above examples, the product catch includes a motor configured to apply force to the product catch in the first direction in order to move the product catch to receive a product from the plurality of trays.

In one or more of the above examples, the product catch further includes a gear coupled to the motor, wherein the motor rotates the gear to rotate a hinged plate coupled to the product catch.

In one or more of the above examples, the product catch is coupled to a frame, and wherein the frame does not rotate with the product catch in the second direction.

In one or more of the above examples, at least part of the frame rotates with the product catch in the first direction.

In one or more of the above examples, the frame include a hinge to couple the frame to the product catch, wherein the product catch further includes a second motor, the second motor configured to rotate the product catch in the second direction by rotating the hinge.

In one or more of the above examples, the product catch includes a plurality of sidewalls.

In one or more of the above examples, atop of a first sidewall of the plurality of sidewalls of the product catch is hingedly coupled to a frame of the product catch.

In one or more of the above examples, the product catch further includes a ledge disposed at a top of a second sidewall of the plurality of sidewalls, wherein the ledge extends horizontally from a center of the product catch.

In one or more of the above examples, the chassis further includes a discharge ledge extending from a wall of the chassis into an interior of the chassis, and wherein the discharge ledge is disposed above the access port.

In one or more of the above examples, the ledge of the product catch is configured to interact with the discharge ledge in order to rotate the product catch in the second direction to eject a product from the product catch into the access port.

In one or more of the above examples, the product catch includes a platform disposed at a base of the product catch, and the vending machine further comprising one or more release mechanisms configured to release a product from one of the plurality of trays when the platform of the product catch depresses the one or more release mechanisms when product catch moves in the first direction.

In one or more of the above examples, an angle of the product catch is similar to an angle of the plurality of columns when the product catch moves in the first direction.

In one or more of the above examples, an angle of the product catch is greater than an angle of the plurality of columns when the product catch moves in the first direction.

One or more example embodiments provide a method of dispensing a product from a tray to a delivery port, the method comprising moving a product catch in a first direction, accepting a product from a plurality of trays, moving a stage to a discharge position, moving the product catch in a second direction, and depositing the product in an access port as a result of the movement of the product catch.

In one or more of the above examples, depositing the product in the access port includes moving the product catch to a position over the access port, and ejecting the product from the product catch into the access port.

In one or more of the above examples, the product catch includes a plurality of sidewalls, wherein a top of a first sidewall of the plurality of sidewalls is hingedly coupled to a frame, and a ledge disposed at a top of a second sidewall of the plurality of sidewalls, wherein the ledge extends horizontally from a center of the product catch.

In one or more of the above examples, ejecting the product into the access port includes contacting a discharge ledge by the ledge of the product catch, moving the product catch in the second direction as a result of the ledge of the product catch contacting the discharge ledge, wherein the frame does not move with the product catch in the second direction, and pushing, by the first sidewall of the product catch, the product into the access port.

In one or more of the above examples, the method further comprises depressing, by a platform of the product catch, a release mechanism of a product column to release the product into the product catch.

In one or more of the above examples, moving the product catch in the first direction includes rotating, by a motor, a gear, wherein the gear meshes with teeth of a hinge plate coupled to the product catch, and rotating the hinged plate by the gear to rotate the product catch in the first direction.

One or more example embodiments provide a method of delivering a product in a vending machine from a column in a tray to a product catch, the method comprising providing a product catch coupled to a stage, initiating release of a product from the column, accepting by the product catch the product from the column, and pushing by a pusher assembly a next product in the column towards a release mechanism of the column, wherein the pusher assembly comprises a spring and a damper, and wherein the damper counteracts a force of the spring and decreases a velocity of the pusher assembly when the pusher assembly pushes the next product towards the release mechanism of the column.

It may be advantageous to set forth definitions of certain words and phrases used throughout this patent document. The terms "transmit," "receive," and "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While the present disclosure has described certain embodiments and generally associated methods, alterations and permutations of these embodiments and methods will be apparent to those skilled in the art. Accordingly, the above description of example embodiments does not define or constrain the present disclosure. Other changes, substitutions, and alterations are also possible without departing from the spirit and scope of the present disclosure, as defined by the following claims.

What is claimed is:

1. A vending machine, comprising:

an access port;

a chassis including a plurality of trays and a plurality of columns;

a movable stage;

a product catch coupled to the movable stage;

a hinged plate coupled to the product catch; and a motor and a gear configured to apply force to the hinged plate and operable to move the product catch in a first direction to accept a product from one of the plurality of trays, wherein the product catch is coupled to a frame by a hinge and is operable to move via the hinge in a second direction perpendicular to the first direction to deposit the product in the access port, wherein the hinged plate is configured to rotate about a first pivot point and the product catch is configured to rotate about a second pivot point defined by the hinge.

2. The vending machine of claim 1, wherein when the motor rotates, the gear moves the hinged plate to cause the product catch to rotate.

3. The vending machine of claim 2, wherein the frame does not rotate with the product catch in the second direction.

4. The vending machine of claim 2, wherein at least part of the frame rotates with the product catch in the first direction.

5. The vending machine of claim 3, wherein the vending machine further comprises a second motor configured to rotate the product catch in the second direction by rotating the hinge.

6. The vending machine of claim 1, wherein the product catch includes a plurality of sidewalls.

7. The vending machine of claim 6, wherein a top of a first sidewall of the plurality of sidewalls of the product catch is hingedly coupled to the frame of the product catch via the hinge.

8. The vending machine of claim 7, wherein the product catch further includes a ledge disposed at a top of a second sidewall of the plurality of sidewalls, wherein the ledge extends horizontally from a center of the product catch.

9. The vending machine of claim 8, wherein the chassis further includes a discharge ledge extending from a wall of the chassis into an interior of the chassis, and wherein the discharge ledge is disposed above the access port.

10. The vending machine of claim 9, wherein the ledge of the product catch is configured to interact with the discharge ledge in order to rotate the product catch in the second direction to eject the product from the product catch into the access port.

11. The vending machine of claim 1, wherein the product catch includes a platform disposed at a base of the product catch, and the vending machine further comprising:

one or more release mechanisms configured to release a product from one of the plurality of trays when the platform of the product catch depresses the one or more release mechanisms when the product catch moves in the first direction.

12. The vending machine of claim 1, wherein an angle of the product catch corresponds to an angle of the plurality of columns when the product catch moves in the first direction.

13. The vending machine of claim 1, wherein an angle of the product catch is greater than an angle of the plurality of columns when the product catch moves in the first direction.

14. A method of dispensing a product from a tray to an access port, the method comprising:

moving a product catch to a dispense position, wherein the product catch is coupled to a frame by a hinge;

moving the product catch in a first direction, comprising:

rotating, by a motor and a gear, a hinged plate coupled to the product catch about a first pivot point to rotate the product catch in the first direction;

accepting a product from a plurality of trays;

moving the product catch to a discharge position;

rotating the product catch about a second pivot point defined by the hinge in a second direction perpendicular to the first direction; and depositing the product in an access port as a result of the moving of the product catch via the hinge in the second direction.

15. The method of claim 14, wherein depositing the product in the access port includes:

moving the product catch to a position over the access port; and ejecting the product from the product catch into the access port.

16. The method of claim 15, wherein the product catch includes:

a plurality of sidewalls, wherein a top of a first sidewall of the plurality of sidewalls is hingedly coupled to the frame via the hinge; and a ledge disposed at a top of a second sidewall of the plurality of sidewalls, wherein the ledge extends horizontally from a center of the product catch.

17. The method of claim 16, wherein ejecting the product into the access port includes:

contacting a discharge ledge by the ledge of the product catch;

moving the product catch in the second direction as a result of the ledge of the product catch contacting the discharge ledge, wherein the frame does not move with the product catch in the second direction; and pushing, by the first sidewall of the product catch, the product into the access port.

18. The method of claim 14, further comprising depressing, by a platform of the product catch, a release mechanism of a product column to release the product into the product catch.

19. A vending machine, comprising:

a chassis comprising a plurality of trays, a plurality of columns and an access port; and a movable stage configured to move a cup assembly to a dispense position and to a discharge position, the cup assembly comprising:

a product catch coupled to a frame, the product catch configured to move in a first direction to receive a product from one of the plurality of trays; and a motor and a gear coupled to a hinged plate, the hinged plate coupled to the product catch and configured to move the product catch in the first direction to receive the product, wherein the product catch is coupled to the frame by a hinge and is further configured to move in a second direction perpendicular to the first direction to discharge the product from the product catch into the access port when the cup assembly is at the discharge position, and wherein the hinged plate is configured to rotate about a first pivot point and the product catch is configured to rotate about a second pivot point defined by the hinge.

* * * * *